US011208276B2

(12) United States Patent
Osada et al.

(10) Patent No.: US 11,208,276 B2
(45) Date of Patent: Dec. 28, 2021

(54) PAPER SHEET LOADING DEVICE AND LOAD ADJUSTING METHOD

(71) Applicant: Japan Cash Machine Co., Ltd., Osaka (JP)

(72) Inventors: Yoshihito Osada, Osaka (JP); Kazuya Furumachi, Osaka (JP)

(73) Assignee: Japan Cash Machine Co., Ltd., Osaka (JP)

( * ) Notice: Subject to any disclaimer, the term of this patent is extended or adjusted under 35 U.S.C. 154(b) by 208 days.

(21) Appl. No.: 16/493,186

(22) PCT Filed: Feb. 23, 2018

(86) PCT No.: PCT/JP2018/006639
§ 371 (c)(1),
(2) Date: Sep. 11, 2019

(87) PCT Pub. No.: WO2018/220913
PCT Pub. Date: Dec. 6, 2018

(65) Prior Publication Data

US 2020/0010292 A1 Jan. 9, 2020

(30) Foreign Application Priority Data

Jun. 2, 2017 (JP) ..... JP2017-110085

(51) Int. Cl.
*B65H 1/24* (2006.01)
*B65H 1/06* (2006.01)
(Continued)

(52) U.S. Cl.
CPC ..... *B65H 1/24* (2013.01); *B65H 1/06* (2013.01); *B65H 3/063* (2013.01); *B65H 3/54* (2013.01);
(Continued)

(58) Field of Classification Search
CPC ... B65H 1/06; B65H 1/08; B65H 1/14; B65H 1/18; B65H 1/24; B65H 3/063;
(Continued)

(56) References Cited

U.S. PATENT DOCUMENTS 2,689,731 A * 9/1954 Peters ..... B65H 1/24 271/166
8,210,523 B2 * 7/2012 Maekawa ..... B65H 1/24 271/126
(Continued)

FOREIGN PATENT DOCUMENTS

JP S48-34622 A 5/1973
JP H06-305586 A 11/1994
(Continued)

OTHER PUBLICATIONS

WIPO, Japanese International Search Authority, International Search Report with English translation and Written Opinion dated May 15, 2018 in International Patent Application No. PCT/JP2018/006639, 9 pages.

*Primary Examiner* — Prasad V Gokhale
(74) *Attorney, Agent, or Firm* — Masuvalley & Partners

(57) ABSTRACT

Provided is a paper sheet loading device including a paper sheet loading unit having a bottom plate and a front wall, a feed roller that comes in contact with a bottom surface of a lowermost paper sheet of a batch of paper sheets and rotates to feed the lowermost paper sheet to outside of the paper sheet loading unit, and a load adjusting member arranged so as to protrude into the paper sheet loading unit and retreat to outside of the paper sheet loading unit. At a time of protrusion of the load adjusting member, the load adjusting member presses a front side face of the batch of paper sheets by a pressing surface to displace the front side face to an innermost part, and receives a load from the batch of paper
(Continued)

sheets by the pressing surface, thereby reducing the load applied to the feed roller from the batch of paper sheets.

5 Claims, 14 Drawing Sheets

(51) Int. Cl.
*B65H 7/02* (2006.01)
*B65H 3/06* (2006.01)
*B65H 3/54* (2006.01)

(52) U.S. Cl.
CPC ..... *B65H 7/02* (2013.01); *B65H 2405/1134* (2013.01); *B65H 2511/152* (2013.01)

(58) Field of Classification Search
CPC ..... B65H 3/24; B65H 3/242; B65H 3/247; B65H 3/32; B65H 3/322; B65H 3/327; B65H 3/34; B65H 3/54; B65H 3/66; B65H 7/00; B65H 7/02; B65H 7/04; B65H 7/20; B65H 2405/113; B65H 2405/1132; B65H 2405/1134; B65H 2405/1136; B65H 2511/152
See application file for complete search history.

(56) References Cited

U.S. PATENT DOCUMENTS

| | | | | |
|---|---|---|---|---|
| 2002/0125628 | A1* | 9/2002 | Chen | B65H 1/06 271/10.12 |
| 2019/0010001 | A1* | 1/2019 | Maynard | B65H 3/063 |

FOREIGN PATENT DOCUMENTS

| | | | |
|---|---|---|---|
| JP | 2000-044065 | A | 2/2000 |
| JP | 3866090 | B2 | 1/2007 |
| WO | WO2008/096428 | A1 | 5/2010 |

* cited by examiner

PAPER SHEET LOADING DEVICE AND LOAD ADJUSTING METHOD

RELATED APPLICATIONS

This application is the U.S. National Phase of and claims priority to International Patent Application No. PCT/JP2018/006639, International Filing Date Feb. 23, 2018, entitled Paper Sheet Loading Device And Load Adjusting Method; which claims benefit of Japanese Application No. 2017-110085 filed Jun. 2, 2017; both of which are incorporated herein by reference in their entireties.

FIELD

The present invention relates to a paper sheet loading device installed in various types of paper sheet handling devices such as a paper sheet counting device, and improvement of a load adjusting method.

BACKGROUND

A banknote counting device has a configuration in which banknotes are counted while feeding banknotes one by one from a batch of banknotes set in a banknote storing unit in a stacked state.

In a paper sheet feeding device according to Patent Literature 1, such a configuration is disclosed that a considerable number of paper sheets are stacked in a vertically stacked state on a bottom plate inclined downward in a feeding direction, and the paper sheets are fed one by one from the lowermost paper sheet by using a kicker roller. By receiving the load of the stacked paper sheets by the inclined bottom plate, the load of the paper sheets being fed can be reduced, and even if a considerable number of paper sheets are stacked on the bottom plate, the paper sheets can be fed smoothly.

In a device that supports counting and classification/sorting of paper sheets such as banknotes, the authenticity and the type (denomination) of paper sheets are judged and counting or the like is performed while feeding and transporting the paper sheets one by one from a batch of paper sheets of different sizes in a mixed state. At this time, if the size of the bottom plate that receives the load of the stacked paper sheets is set matched with the maximum size of paper sheets, erroneous feed such as skew or double feeding occurs with respect to paper sheets of a small size. On the other hand, if the size of the bottom plate is set matched with the paper sheets of a small size, the load applied to the kicker roller from the paper sheets of a large size decreases, thereby causing a problem such that a kicking force cannot be applied sufficiently and a feed timing is delayed.

When the number of banknotes on the bottom plate is an appropriate number such as 500 sheets, a frictional resistance between the surface of the lowermost banknote and the kicker roller exceeds the frictional resistance between the banknotes, thereby enabling to feed the lowermost banknote one by one. However, if feeding by rotating the kicker roller is started in a state in which a large number of banknotes, for example, 1000 to 2000 sheets are stacked on the bottom plate, the frictional resistance between the banknotes becomes excessive due to the own weight of the banknotes, and the load applied to the kicker roller from the stacked batch of banknotes becomes excessive. Therefore, double feeding occurs such that the lowermost banknote is fed together with another banknote on top thereof.

This problem is not limited to a banknote counting device, and also occurs similarly in banknote handling devices such as various types of vending machines, deposit and dispense devices, and money change machines that have a configuration for feeding banknotes one by one according to need while accommodating a considerable number of banknotes in a stacked state.

CITATION LIST

Patent Literature

Patent Literature 1: Japanese Patent No. 3866090

SUMMARY

Technical Problem

The present invention has been achieved in view of the above problem, and an object of the present invention is to provide a paper sheet loading device having a paper sheet feeding function such that even if an excessive load is applied to a feed roller from a large number of paper sheets or paper sheets of different sizes are mixed and loaded, the load is reduced to enable smooth feeding by addition of a simple configuration, and a load adjusting method.

Solution to Problem

In order to achieve the above object, a paper sheet loading device according to the present invention comprises: a paper sheet loading unit having a bottom plate on which a batch of paper sheets is loaded, and a front wall that comes in contact with a front side face of the batch of paper sheets to support the batch of paper sheets; a feed roller that comes in contact with a bottom surface of a lowermost paper sheet of the batch of paper sheets and rotates to feed the lowermost paper sheet to outside of the paper sheet loading unit across the front wall; and a load adjusting member arranged so as to be able to freely protrude into the paper sheet loading unit and retreat to outside of the paper sheet loading unit across the front wall, wherein at a time of protrusion of the load adjusting member, the load adjusting member presses a front side face of the batch of paper sheets by a pressing surface to displace the front side face to an innermost part, and receives a load from the batch of paper sheets by the pressing surface, thereby reducing a load applied to the feed roller from the batch of paper sheets.

Advantageous Effects of Invention

According to the present invention, even if an excessive load is applied to a feed roller from a large number of paper sheets or paper sheets of different sizes are mixed and loaded, the load is reduced to enable smooth feeding by addition of a simple configuration.

DESCRIPTION OF EMBODIMENTS

Figure 1:
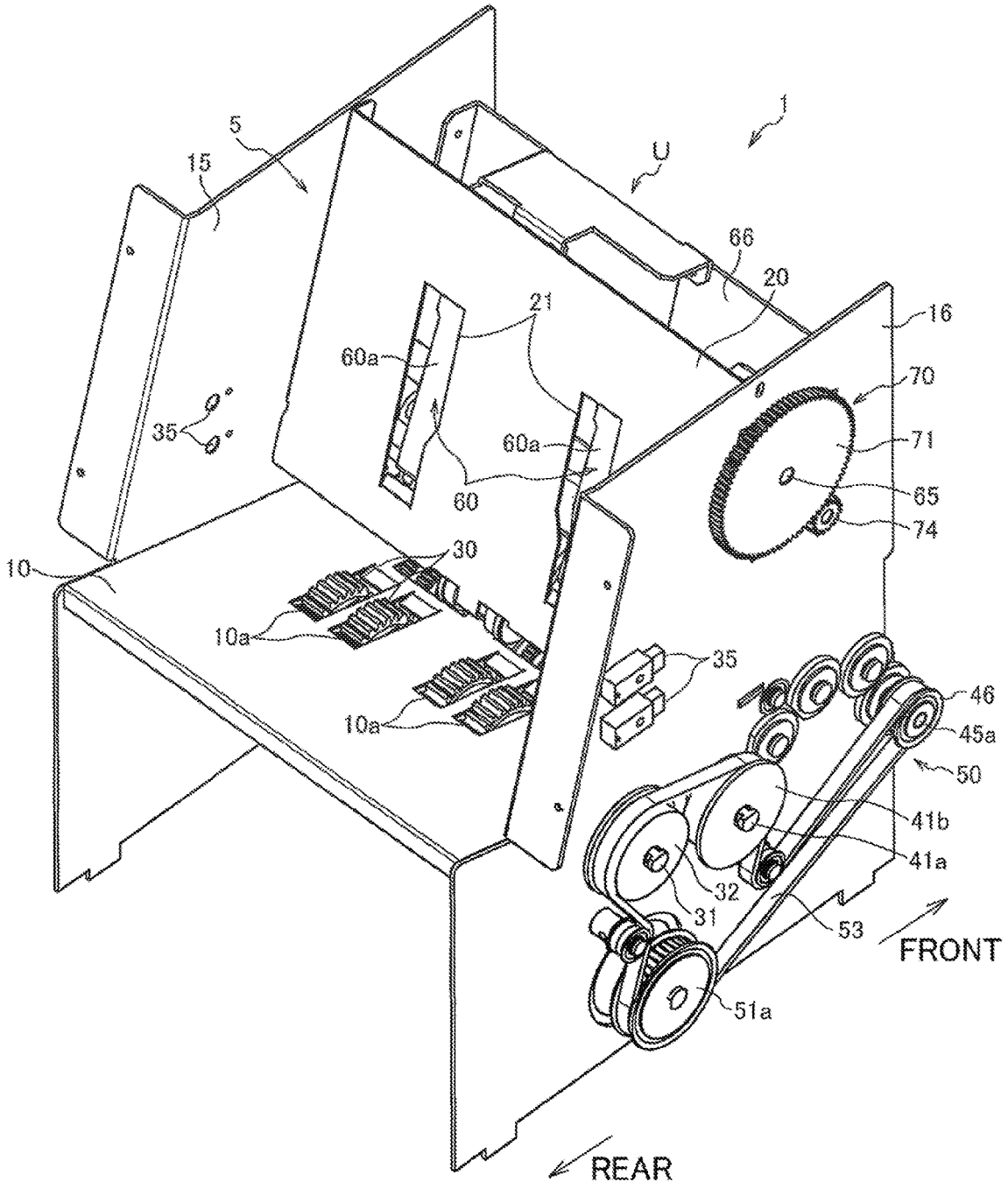
FIG. 1 is a perspective view illustrating an external appearance at the time of activation of a load adjusting member of a paper sheet loading device having a feeding function according to a first embodiment of the present invention.

The present invention will be explained below in detail with embodiments illustrated in the drawings.

<Paper Sheet Loading Device According to First Embodiment>

[Basic Configuration of Paper Sheet Loading Device]

Figure 2B:
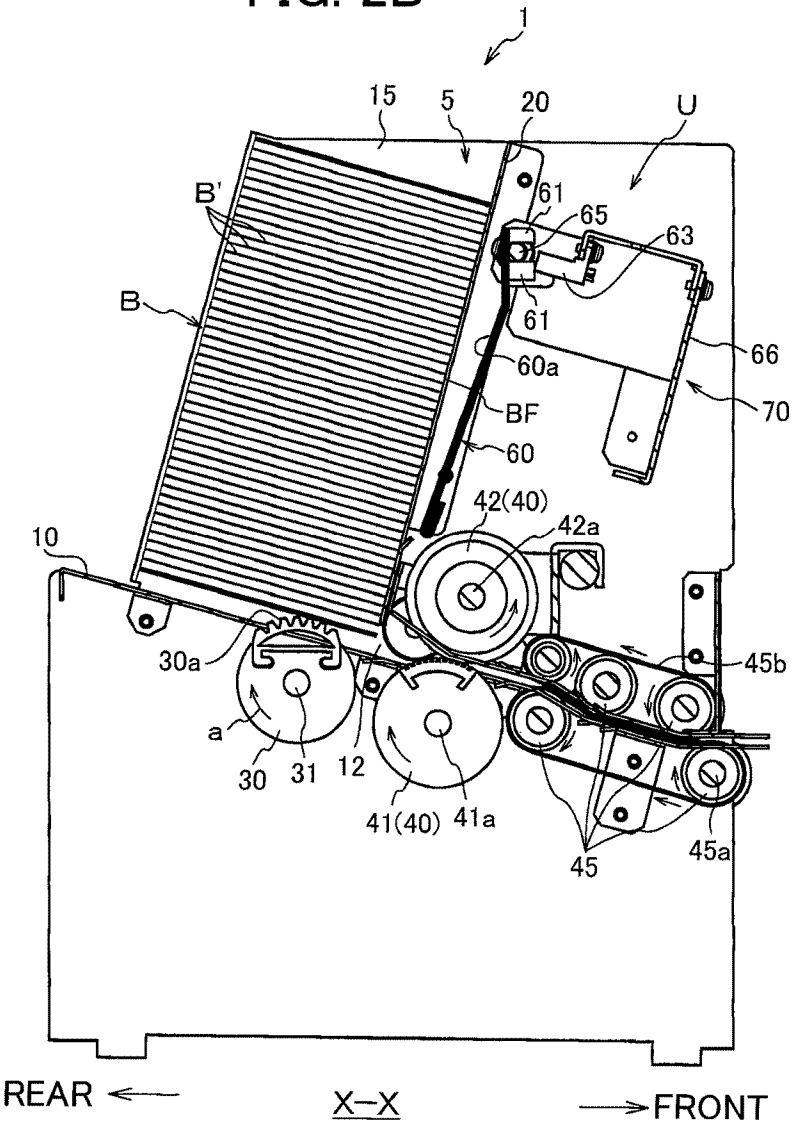
FIGS. 2A and 2B are respectively an elevational view of the paper sheet loading device in FIG. 1 in a paper sheet loaded state, and a sectional view taken along X-X.
Figure 2A:
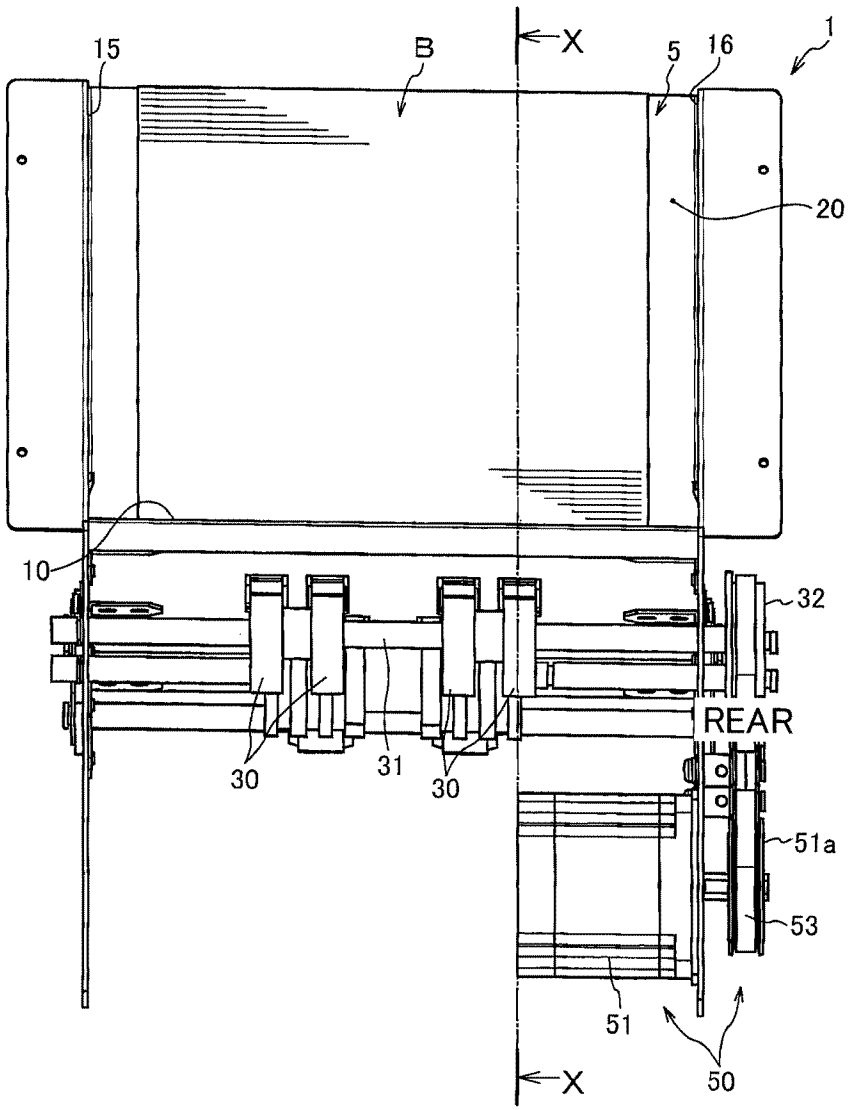
Figure 3:
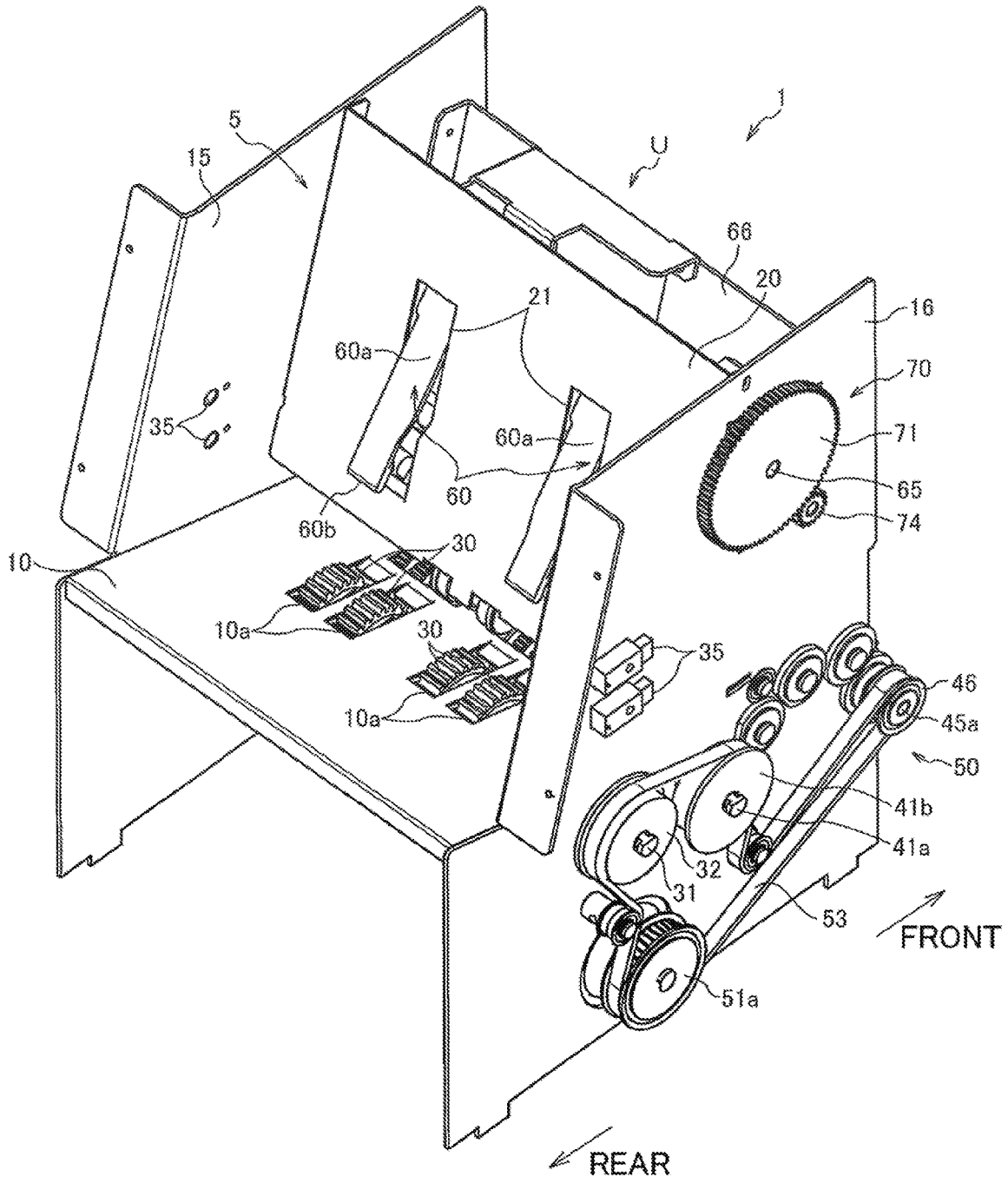
FIG. 3 is a perspective view illustrating an external appearance at the time of activation of the load adjusting member of the paper sheet loading device.
Figure 4B:
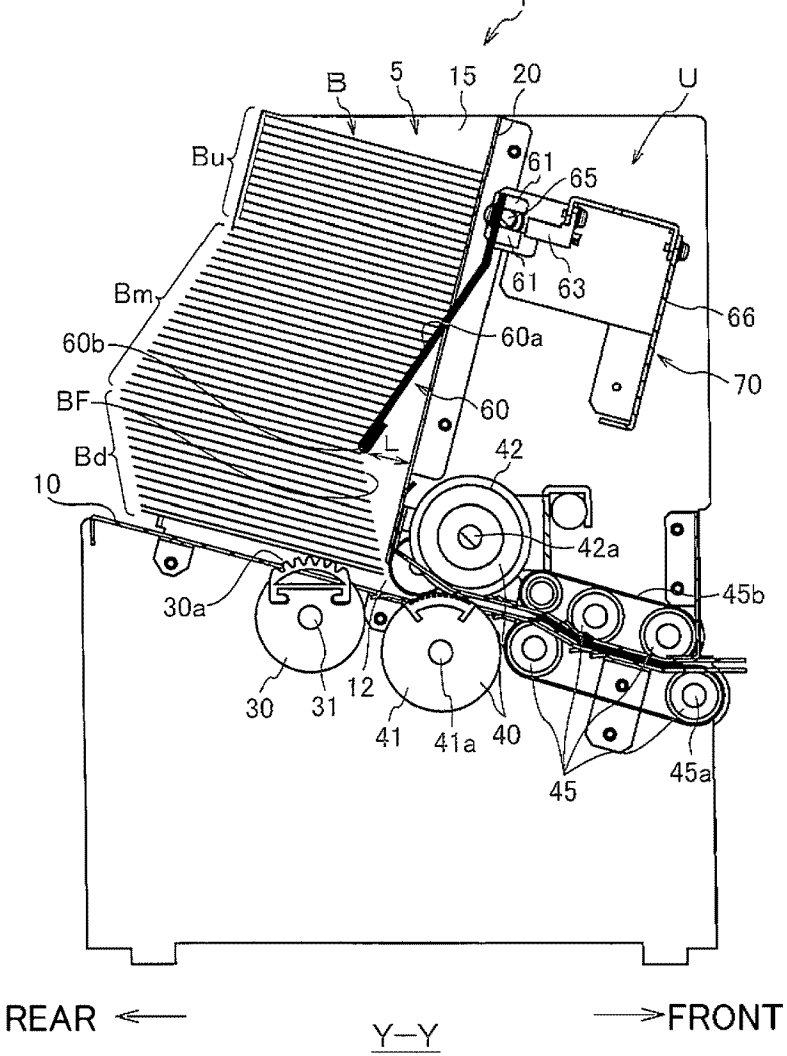
FIGS. 4A and 4B are respectively an elevational view of the paper sheet loading device in a paper sheet loaded state, and a sectional view taken along Y-Y.
Figure 4A:
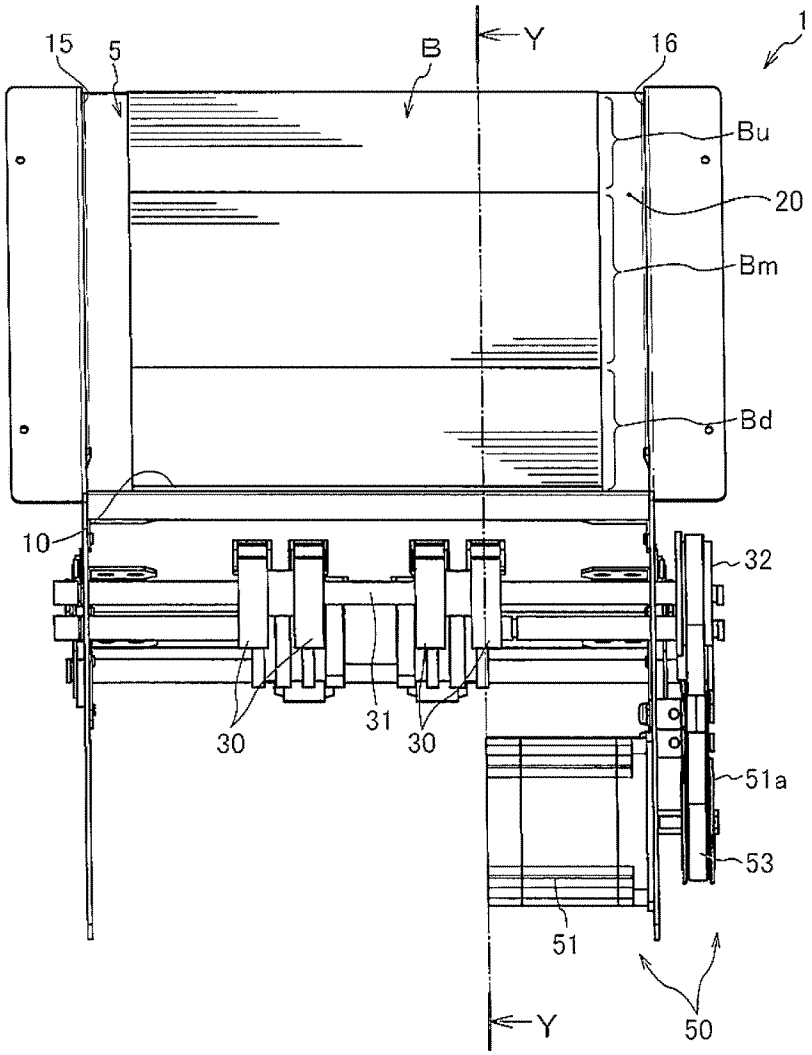
Figure 5:
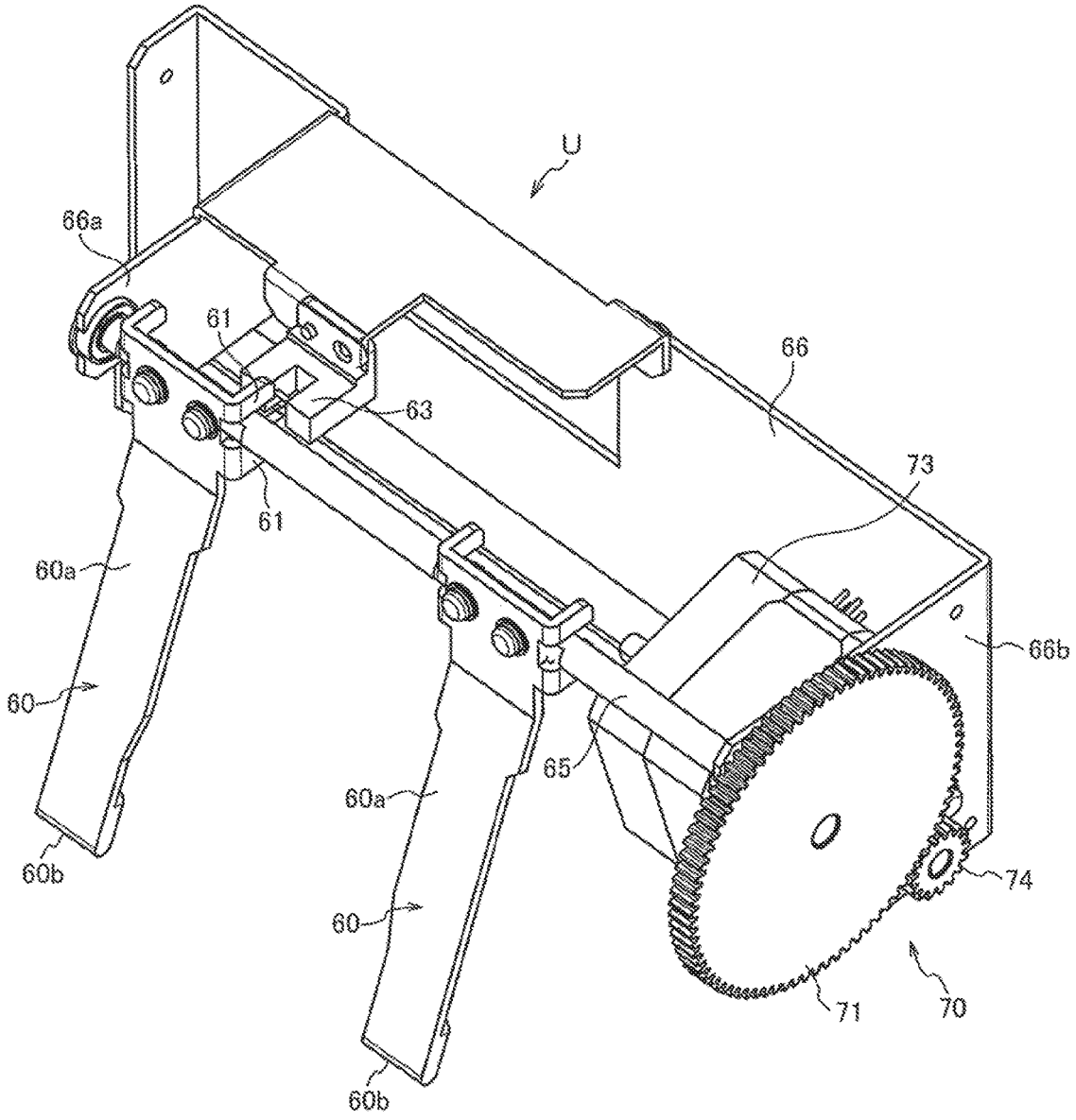
FIG. 5 is an explanatory diagram of a configuration of relevant parts (load adjusting unit) of the paper sheet loading device.

FIG. 1 is a perspective view illustrating an external appearance at the time of non-activation of a load adjusting member of a paper sheet loading device having a paper sheet feeding function according to a first embodiment of the present invention. FIGS. 2A and 2B are respectively an elevational view of the paper sheet loading device in a paper sheet loaded state, and a sectional view taken along X-X. FIG. 3 is a perspective view illustrating an external appearance at the time of activation of the load adjusting member of the paper sheet loading device. FIGS. 4A and 4B are respectively an elevational view of the paper sheet loading device in a paper sheet loaded state, and a sectional view taken along Y-Y. FIG. 5 is an explanatory diagram of a configuration of relevant parts (load adjusting unit) of the paper sheet loading device.

In the present embodiment, a paper sheet counting device is illustrated as an example of a paper sheet handling device including the paper sheet loading device.

In the present embodiment, a paper sheet counting device is illustrated as an example of a paper sheet handling device including the paper sheet loading device.

A banknote counting device (paper sheet counting device) 1 includes a banknote loading unit (paper sheet loading unit) 5 that has a bottom plate 10 on which a large number of banknotes (paper sheets) B' are loaded in a stacked state, that is, in a state of being stacked in a vertical direction (in a diagonally vertical direction) (in a batch state of banknotes), right and left side plates 15 and 16, and a front wall 20 that comes in contact with a front side face BF of the loaded batch of banknotes (a stacked batch of banknotes) B to support the batch of banknotes. Further, the banknote counting device 1 includes a feed roller 30 that comes in contact with the bottom surface of the lowermost banknote exposed through an opening (a bottom opening in the front wall) 10*a* provided in a bottom part (the bottom plate 10) of the banknote loading unit 5 and rotates to feed the lowermost banknote to outside (forward) of the banknote loading unit 5 across the front wall 20. The banknote counting device 1 also includes a separation roller pair (a friction roller 41 and a reverse roller 42) 40 arranged on the downstream side in a feeding direction of the feed roller 30, a transport roller group 45 that transports a separated banknote further to the downstream side, and a drive mechanism 50 that drives the feed roller 30, the separation roller pair 40, and the transport roller group 45 (a belt 45*b*). The banknote counting device 1 also includes a load adjusting member (load reducing member) 60 arranged so as to be able to freely protrude into and retreat (retractable) from the banknote loading unit 5 through an opening portion (communicating portion) 21 formed in an appropriate place in the front wall 20, a drive mechanism (retractable drive mechanism) 70 that activates the load adjusting member 60, a banknote counter (counter) (not illustrated) located on the downstream side of the transport roller 45, and a control unit (a CPU, a ROM, a RAM) (not illustrated) that controls various types of control targets such as the respective drive mechanisms 50 and 70 and the banknote counter. When the load adjusting member 60 protrudes into the banknote loading unit 5 from the opening portion 21 by the drive mechanism 70, the front side face BF of the loaded batch of banknotes exposed in the opening portion is pressed and displaced to an innermost part (rearward), so that the load adjusting member 60 receives the load from the pressed banknotes and banknotes on top thereof to reduce the load applied to the feed roller 30.

The banknote loading unit 5, the feed roller 30, and the load adjusting member 60 constitute the banknote loading device.

The bottom plate 10 located at the bottom part of the banknote loading unit 5 is inclined forward, which is a banknote feeding direction, and downward to feed the lowermost banknote of a banknote batch B fed by the feed roller 30 forward of the banknote batch B from a feeding port 12, which is a space formed between the lowermost banknote and a lower part of the front wall 20. If the fed banknote is in a double feeding state in which two or more banknotes are overlapped, only the lowest one of the banknotes is fed forward by cooperation of the friction roller 41 and the reverse roller 42 constituting the separation roller pair 40, and the remaining upper banknote is returned and transported to the side of the banknote loading unit 5.

The drive mechanism 50 drives the feed roller 30, the separation roller pair 40, and the transport roller group 45 by a common motor 51 fixed inside of the lower part of the side plate 16. An output pulley 51*a* fixed to an output shaft of the motor 51 rotates the feed roller 30 by a predetermined angle in a paper feeding direction (a clockwise direction) indicated by an arrow a in FIGS. 2A and 2B, at the time of feeding the banknote, to come in contact with a lower surface of the lowermost banknote and feed the banknote by a predetermined distance by a high frictional portion 30*a*. When the fed banknote is only one, the separation roller pair 40 and the transport roller 45 transport the banknote to the downstream side, and the transport roller group 45 is driven in a direction indicated by an arrow to further feed the banknote to the banknote counter on the downstream side. When the banknote is in a double feeding state, the friction roller 41 in contact with the lower banknote rotates in the clockwise direction in FIG. 2B, while the reverse roller 42 rotates in a return direction (a counterclockwise direction) indicated by an arrow with small torque, thereby returning the upper overlapping banknote in a reverse direction. There are various kinds of double feeding preventing mechanisms, and this is only an example.

The reverse roller 42 includes a one-way clutch provided on a rotation shaft thereof and is driven and rotated only in a direction of returning banknotes to the banknote loading unit 5.

A gear can be used instead of the pulley and a chain can be used instead of the timing belt.

The drive mechanism (retractable drive mechanism) 70 for causing the two load adjusting members 60 to appear and retreat simultaneously includes a driven gear 71 with a shaft center being fixed to an end of a rotation shaft 65 that is horizontally spanned between the right and left side plates 15 and 16, and is pivotally supported at both ends, and a motor 73 that transmits a driving force in forward and reverse directions from an output gear 74 to the driven gear 71. The two load adjusting members 60 in the present example are thin plate members in a narrow belt shape, with one end being fixed to an appropriate place of the rotation shaft 65, and is configured so as to be displaceable between a retreating posture illustrated in FIG. 1 and FIGS. 2A and 2B and a protruding posture illustrated in FIG. 3 and FIGS. 4A and 4B. An attaching angle of the respective load adjusting members 60 with respect to the rotation shaft 65 is constant.

The load adjusting member 60 has a rigid configuration that is not elastically deformed. Therefore, the load adjusting member 60 can transmit a squeezing force generated by the rotation of the rotation shaft 65 effectively to the batch of banknotes so that the front side face BF of the batch of banknotes is squeezed reliably and efficiently to deform the stacked state. After completion of squeezing, a part of the load from the banknote group coming in contact with the pressing surface 60*a* and from the banknote group on top thereof can be reliably supported continuously by the pressing surface.

By configuring the load adjusting member 60 to elastically deform slightly when all or a part of the load adjusting member 60 presses the batch of banknotes, the side face of the batch of banknotes can be prevented from being pressed by an excessive force to damage the individual banknote.

In the present example, while two load adjusting members 60 having the same shape are provided, the shape, the width, and the number of the load adjusting member 60 can be variously modified. Regardless of how the load adjusting member is configured, it is necessary to configure the load adjusting member to press a line-symmetric position with a central portion in a longitudinal direction of the batch of banknotes being the center, and by configuring the load adjusting member in this manner, right and left imbalance at the time of pressing can be prevented.

Further, by configuring the load adjusting member 60 such that a tip edge 60*b* thereof becomes a horizontal straight line, that is, a straight line substantially parallel to a surface direction of an individual banknote B' constituting the banknote batch B, a banknote substantially at the same level, when the side face of the batch of banknotes is pressed, can be pressed to be pushed up and squeezed to change the stacked state of the batch of banknotes with a good balance.

As illustrated in FIG. 5, the rotation shaft 65 is pivotally supported by two side plates 66*a* and 66*b* of a support member 66 in a U shape as seen in a planar view, and can be unitized by assembling these constituent elements with the support member 66. The load adjusting member 60, the rotation shaft 65, the support member 66, the drive mechanism 70, and the like constitute a load adjusting unit U.

A small protrusion provided at the base end of one of the load adjusting members 60 is a detection piece 61. Since the detection piece 61 enters into and comes out from a sensor 63 formed of a photo interrupter or the like in the process while the load adjusting member 60 turns, the control unit can ascertain the angle of the load adjusting member 60 (whether the load adjusting member 60 is activated) based on an on/off signal at that time.

[Explanations of Operation of Paper Sheet Loading Device According to First Embodiment]

The banknote counting device (paper sheet counting device) 1 having the configurations described above operates in the manner described below.

First, at the time of non-activation of the load adjusting member illustrated in FIG. 1 and FIGS. 2A and 2B, the banknote batch B is aligningly and vertically stacked (in the diagonally vertical direction) in a state with the front side face BF being along the front wall 20.

The present example is described, assuming a case where if the loaded number exceeds a reference value, for example, 1000 sheets, a load exceeding a proper value is applied to the feed roller 30, thereby likely causing double feeding.

According to the present invention, if the loaded number of banknotes (loaded weight) set on the bottom plate 10 of the banknote loading unit 5 exceeds the reference value, this matter is detected by sensors 35 provided on the side plates 15 and 16 and on other places, or an operator operates a start switch (not illustrated) to activate the load adjusting member 60 as a load reducing member as illustrated in FIG. 3 and FIGS. 4A and 4B, to squeeze a position at an intermediate height of the front side face of the batch of banknotes toward the innermost part by a predetermined distance.

A change in the loaded amount can be detected by a change in the height position of the loaded batch of banknotes, by vertically arraying a plurality of sensors 35 along the side plate. Further, by arranging the sensor 35 on the bottom plate, the presence of the banknote can be detected.

In a state with the load adjusting member 60 being squeezed in as illustrated in FIGS. 4A and 4B, the pressing surface 60*a* provided on a rear surface of the load adjusting member 60 comes in contact with the front side face BF of the banknote group in a state being inclined upward, and functions as a load receiving surface that receives the load from the banknote group. In this state, the banknote group below the tip edge 60*b* of the load adjusting member 60 and the banknote group above the tip of the load adjusting member 60 are displaced in a front and back direction in a V shape. The load applied to the feed roller 30 from the banknote batch B is largely reduced after the activation of the load adjusting member than that before the activation thereof by the weight of the banknote group supported by the pressing surface 60*a*. It is a matter of course that not only the load from a banknote group Bm coming in contact with the front edge but also a part of the load from another banknote group Bu stacked thereon are received by the pressing surface 60*a*.

Further, when the load adjusting member is at a protruding position as illustrated in FIG. 4B, the loaded mode is divided into three modes of an upper banknote group Bu with the front edge thereof coming in contact with the front wall 20, a banknote group Bm at an intermediate position with the front edge thereof coming in contact with the pressing surface 60*a* of the load adjusting member, and a lower banknote group Bd with the front edge thereof not coming into contact with any member.

The banknote group Bm at the intermediate position and the lower banknote group Bd are bent in an angulated shape or a V shape toward the inner direction of the banknote loading unit 5. Therefore, the lower banknote group Bd is in a shape of parallelogram with more rearward inclination as the end face on the rear side approaches upward. Therefore, a barycenter of the lower banknote group Bd becomes a state deviated rearward, and thus a part of the load from the loaded banknotes applied to the feed roller 30 at the time of the non-protruding state illustrated in FIG. 2B becomes a state illustrated in FIG. 4B in which the load is transitioned to a rear part of the bottom plate, thereby reducing the load applied to the feed roller as much as the transition.

When the entire amount of the loaded banknotes decreases with progression of feeding by the feed roller, the banknote group Bm at the intermediate position sequentially transitions to the side of the banknote group Bd on the lower side by the action of gravity, and the banknote group Bu on the upper side transitions to the side of the banknote group Bm at the intermediate position.

A proper protrusion length L (a distance between the lower tip edge 60*b* and the front wall 20, FIG. 4B) of the load adjusting member 60 at the time of protrusion is set so that the load applied to the feed roller can be reduced to an optimum value within a range in which the load balance of the deformed loaded batch of banknotes does not deteriorate. Therefore, the protrusion length L can be changed according to the volume of the loaded amount by adjusting the rotation angle of the rotation shaft 65. In the example illustrated in FIG. 4B, the lower tip edge 60*b* of the pressing surface 60*a* slightly overhangs an upper surface of the feed roller 30, particularly, the upper part of the periphery (30*a*) of the feed roller that comes in contact with the lower surface of the banknote. Even with this protrusion length, a sufficient reduction effect of the load to the feed roller can be acquired.

When feeding of the batch of banknotes on the bottom plate is complete, the load adjusting member 60 is returned to an initial position illustrated in FIG. 1 and FIGS. 2A and 2B. When the batch of banknotes is to be added in the middle of banknote feeding, the load adjusting member is returned to the initial state illustrated in FIG. 1 and FIGS. 2A and 2B, so that the load adjusting member does not interfere with the addition of the bath of banknotes.

The load adjusting member 60 is made of metal or resin. A friction coefficient of the pressing surface 60*a* is set so as to generate a necessary and sufficient friction force between the banknote and the pressing surface 60*a* upon activation of the load adjusting member 60, in order to press the front side face of the batch of banknotes by the pressing surface 60*a* including the tip edge 60*b*, and after pressing, continuously support the load from the banknote being in contact therewith. Alternatively, the front surface of the pressing surface 60*a* can be subjected to surface roughening in order to adjust the friction force of the pressing surface 60*a*.

By forming the pressing surface 60*a* substantially in a flat surface, as illustrated in FIG. 4B, a deformation amount of the batch of banknotes to be formed at the time of pressing can be suppressed to a requisite minimum amount. If the deformation amount of the batch of banknotes becomes excessive and a distance of displacement to the innermost part in a V shape becomes too long, disruption of the load balance occurs, thereby causing a problem that the load applied to the feed roller from the batch of banknotes becomes unstable. However, by forming the pressing surface in a flat shape, the inclination angle of the pressing surface at the time of protrusion can be made constant, and thus erroneous feed due to unstable load does not occur. Further, the banknote group coming in contact with the pressing surface 60*a* sequentially moves downward along the pressing surface, as the feed roller continues to feed the banknotes. The inclination angle, frictional resistance, and the like of the pressing surface are set so as not to interfere with smooth downward movement of the banknotes.

Therefore, so long as the deformation amount of the batch of banknotes at the time of pressing does not become excessive and smooth descent of the banknote group coming in contact with the pressing surface is not interfered due to a decrease in the number of banknotes, there is no problem even if the pressing surface 60*a* is formed in a concave shape, is roughened, or is provided with a slightly uneven portion.

In the present example, since the load adjusting member 60 is fixed to the rotation shaft 65 at the upper end thereof, the pressing surface 60*a* turns vertically in an arc-like trajectory by the rotation of the rotation shaft. Therefore, at the time of pressing, the banknote group coming in contact with the pressing surface 60*a* can be scooped up and squeezed in, and at the time of start of pressing, the banknote group can be easily moved onto the pressing surface. At the time of end of pressing, the banknote group can be stably supported continuously on the pressing surface.

However, this configuration is only an example, and it is permissible that the load adjusting member 60 is not turned is linearly moved forward and backward. In this case, the inclination angle of the pressing surface 60*a* is preset to an angle that can easily receive the load from the banknotes after being squeezed in, and the pressing surface 60*a* moves rearward with the inclination angle being maintained to press the side face of the batch of banknotes, and continuously receives the load after pressing. The direction of the linear forward-and-backward motion is not limited to a horizontal direction and can be a diagonally vertical direction.

Alternatively, the load adjusting member can be configured such that a lower part thereof is pivotally supported so as to move forward and backward, and a pressing surface provided in an upper part of the load adjusting member is caused to appear and retreat from an opening portion in the front wall into a banknote loading unit to press the side face of the banknotes.

The load adjusting member 60 can be projected at once, or projected stepwise (gradually). Alternatively, the load adjusting member 60 can be projected while vibrating back and forth, from side to side, or vertically. Due to these subsidiary motions, an effect of handling the banknotes is exerted to enable smooth squeezing, and the deformed state of the batch of banknotes can be made appropriate.

When the load adjusting member 60 protrudes to locally squeeze the side face of the batch of banknotes, it is only necessary to slide the banknotes in a surface direction. Therefore, there is not a large resistance, and after sliding, the load adjusting member 60 continuously receives a part of the load from the banknote group coming in contact with the inclined pressing surface 60*a* of the load adjusting member 60, and other banknote groups stacked on top thereof, thereby enabling to reduce the load applied to the feed roller 30. As illustrated in FIGS. 2A and 2B, at a stage before the load adjusting member protrudes, individual banknotes adhere tightly to each other due to the own excessive weight of the batch of banknotes. However, as illustrated in FIGS. 4A and 4B, since the load adjusting member protrudes, an effect of handling the banknotes can be exerted by the behavior of causing displacement of the banknotes in the direction along the surface direction of the banknotes.

As described above, when much of the load of the batch of banknotes loaded in a considerable amount is received by the feed roller 30, a feeding force (a friction force with the banknote) equal to or more than the proper load is generated to cause an erroneous feed such as double feeding. However, since the load adjusting member 60 has a configuration in which the inclined pressing surface (load receiving surface) 60*a* thereof receives the load of the batch of banknotes, the feed roller can receive a proper load constantly at all times, thereby enabling stable feed. Accordingly, not only double feeding can be prevented, but also even if banknotes of different sizes are mixed and loaded, erroneous feed such as double feeding and skew can be prevented.

<Paper Sheet Loading Device According to Second Embodiment>

Figure 6:
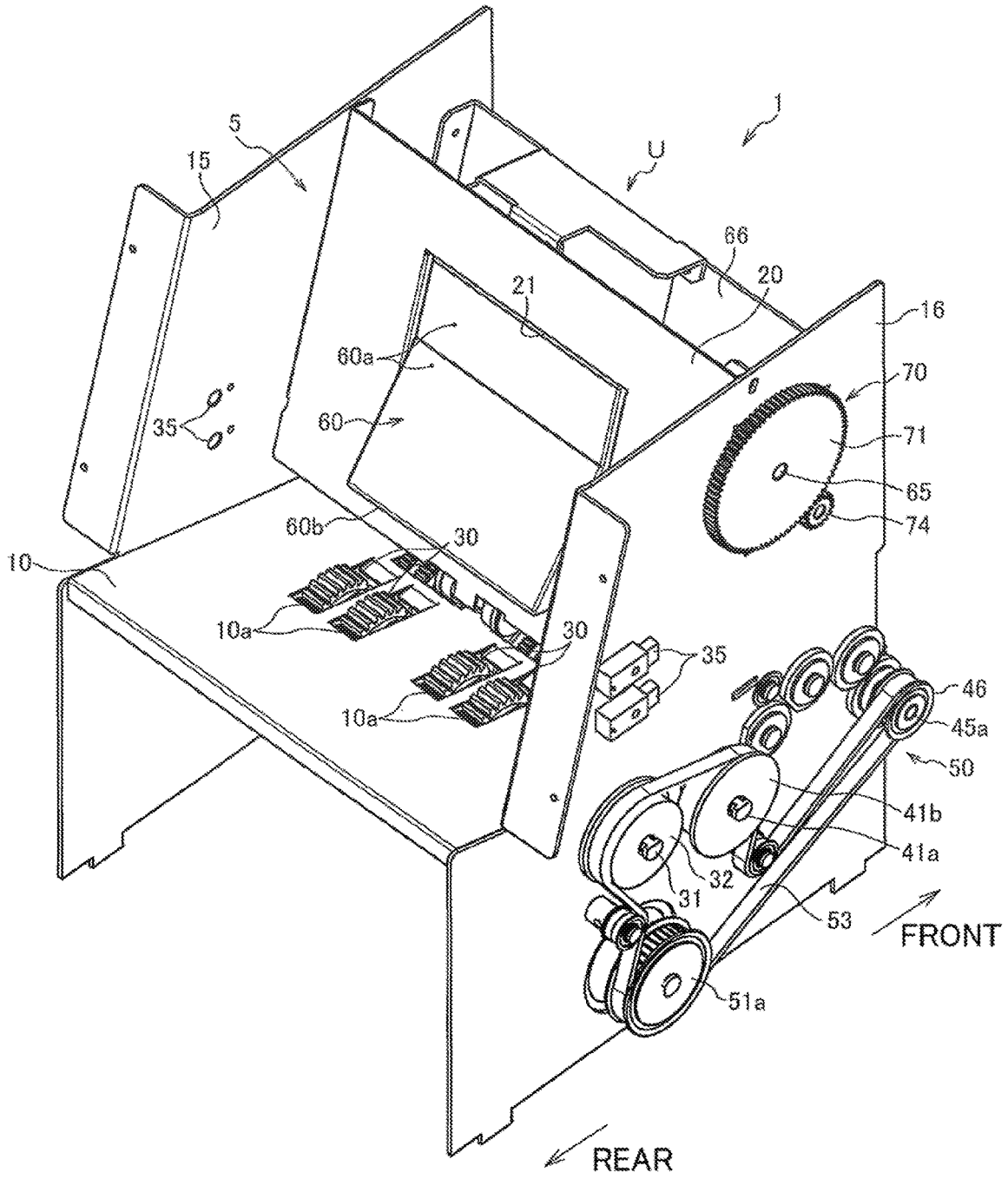
FIG. 6 is a perspective view illustrating an external appearance at the time of activation of a load adjusting member of a paper sheet loading device according to a second embodiment of the present invention.
Figure 7:
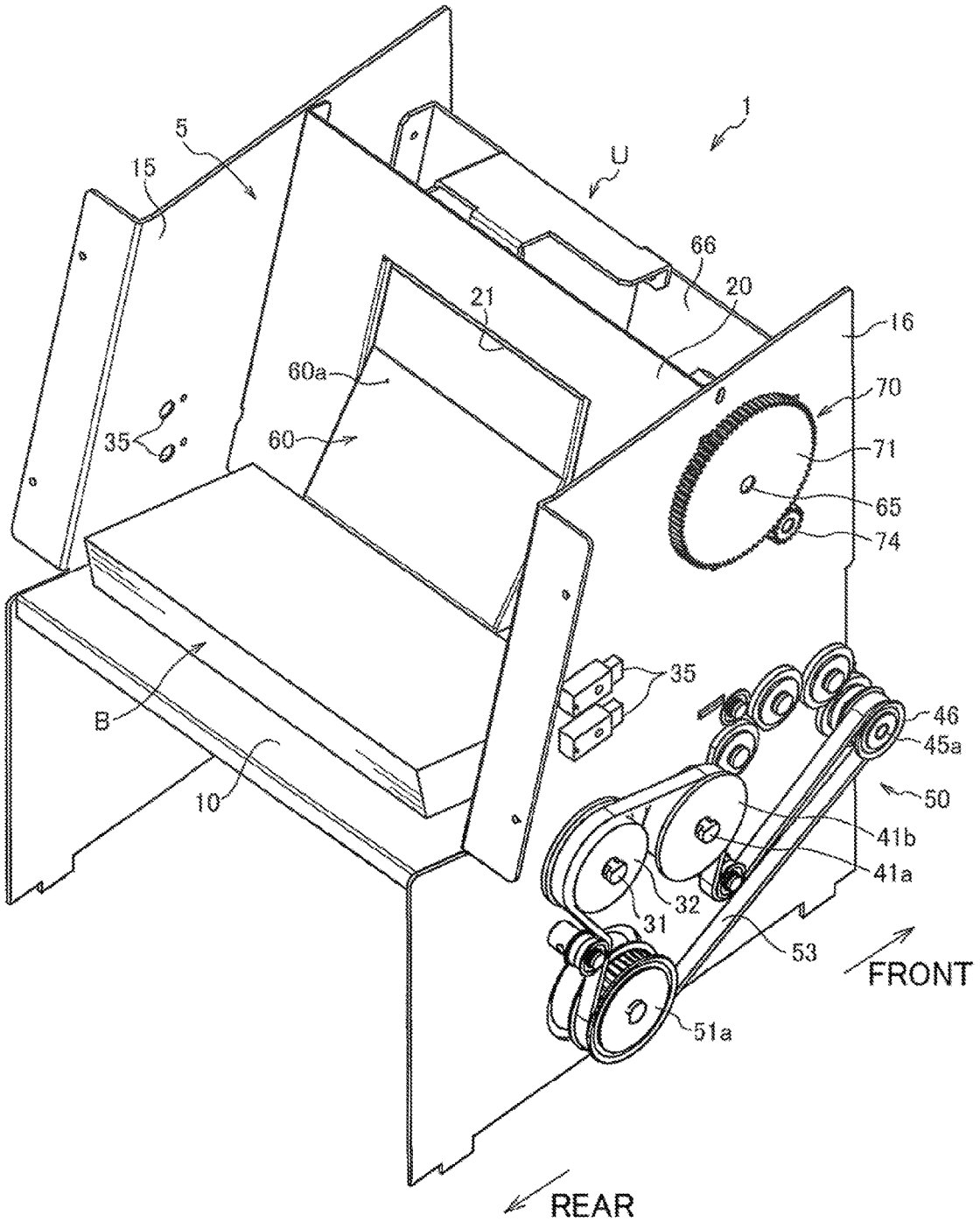
FIG. 7 is a perspective view for explaining the function of the load adjusting member in a state in which the number of banknotes has decreased.
Figure 8A:
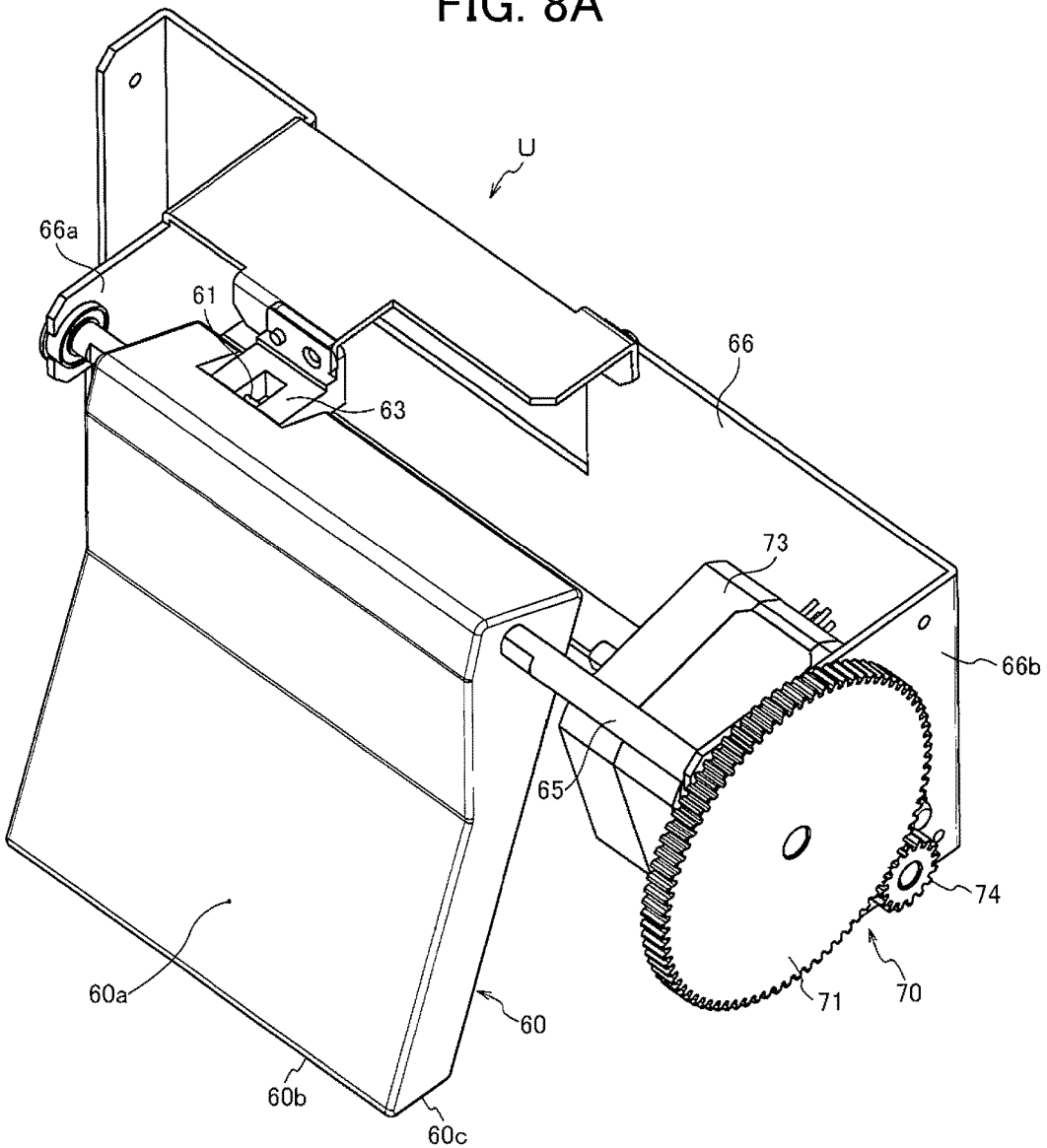
FIG. 8A is a perspective view illustrating a configuration of relevant parts of the paper sheet loading device in FIG. 7.
Figure 8B:
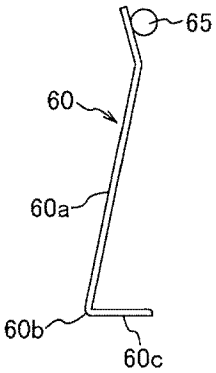
FIG. 8B is a side view illustrating a modification of the load adjusting member.

FIG. 6 is a perspective view illustrating an external appearance at the time of activation of a load adjusting member of a paper sheet loading device according to a second embodiment of the present invention. FIG. 7 is a perspective view for explaining the function of the load adjusting member in a state in which the number of banknotes has decreased. FIG. 8A is a perspective view illustrating a configuration of relevant parts of the paper sheet loading device, and FIG. 8B is a side view illustrating a modification of the load adjusting member.

Parts identical to those of the first embodiment are denoted by like reference signs, and differences from the first embodiment are mainly explained.

The banknote counting device (paper sheet counting device) 1 according to the present embodiment is different from that of the first embodiment in the shape of the load adjusting member 60 as the load reducing member. According to the first embodiment, the load adjusting member 60 is formed in a thin plate shape and includes two members in a narrow belt shape. However, according to the second embodiment, a member having a large lateral width of about one half to two thirds the lateral width of a banknote having the maximum size is used. In this load adjusting member 60, a front and rear width (thickness) of a bottom surface 60*c* is formed large, to exert a function of maintaining the load applied to the feed roller 30 at a proper value, by turning the load adjusting member in a descending direction when the number of banknotes on the bottom plate 10 decreases to pressurize the upper surface of the batch of banknotes downward by the bottom surface 60*c*.

It is a matter of course that the shape of the opening portion 21 formed in the front wall is changed corresponding to the change of the shape of the load adjusting member 60. That is, the shape, the width, and the number of the load adjusting member 60 can be variously modified as described above.

In the inclined pressing surface 60*a* provided on a rear surface of the load adjusting member 60, the inclination angle and the material thereof are selected so that the load from the banknotes coming in contact therewith, when an intermediate part of the front-side end face of the batch of banknotes is pressed and deformed to the innermost part and upward, upon activation of the load adjusting member 60, can be supported continuously and stably.

As illustrated in FIG. 8*b*, the plate member can be formed substantially in an L shape.

<Paper Sheet Loading Device According to Third Embodiment>

Figure 9B:
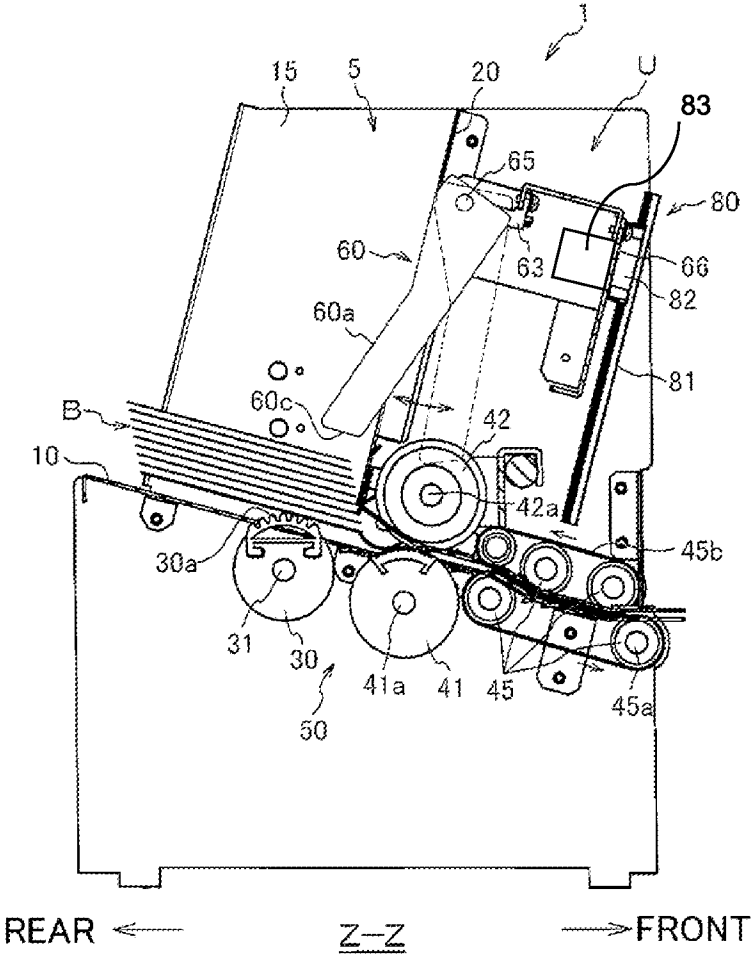
FIGS. 9A and 9B are respectively an elevational view at the time of activation of a load adjusting member of a paper sheet loading device according to a third embodiment of the present invention, and a sectional view taken along Z-Z.
Figure 9A:
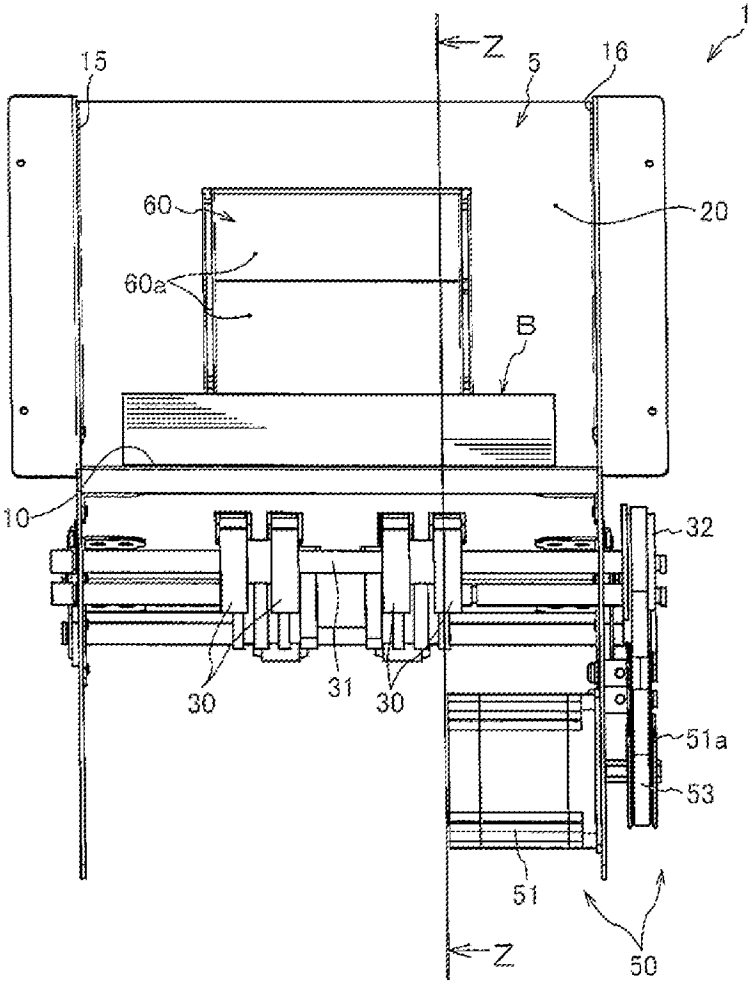
Figure 10:
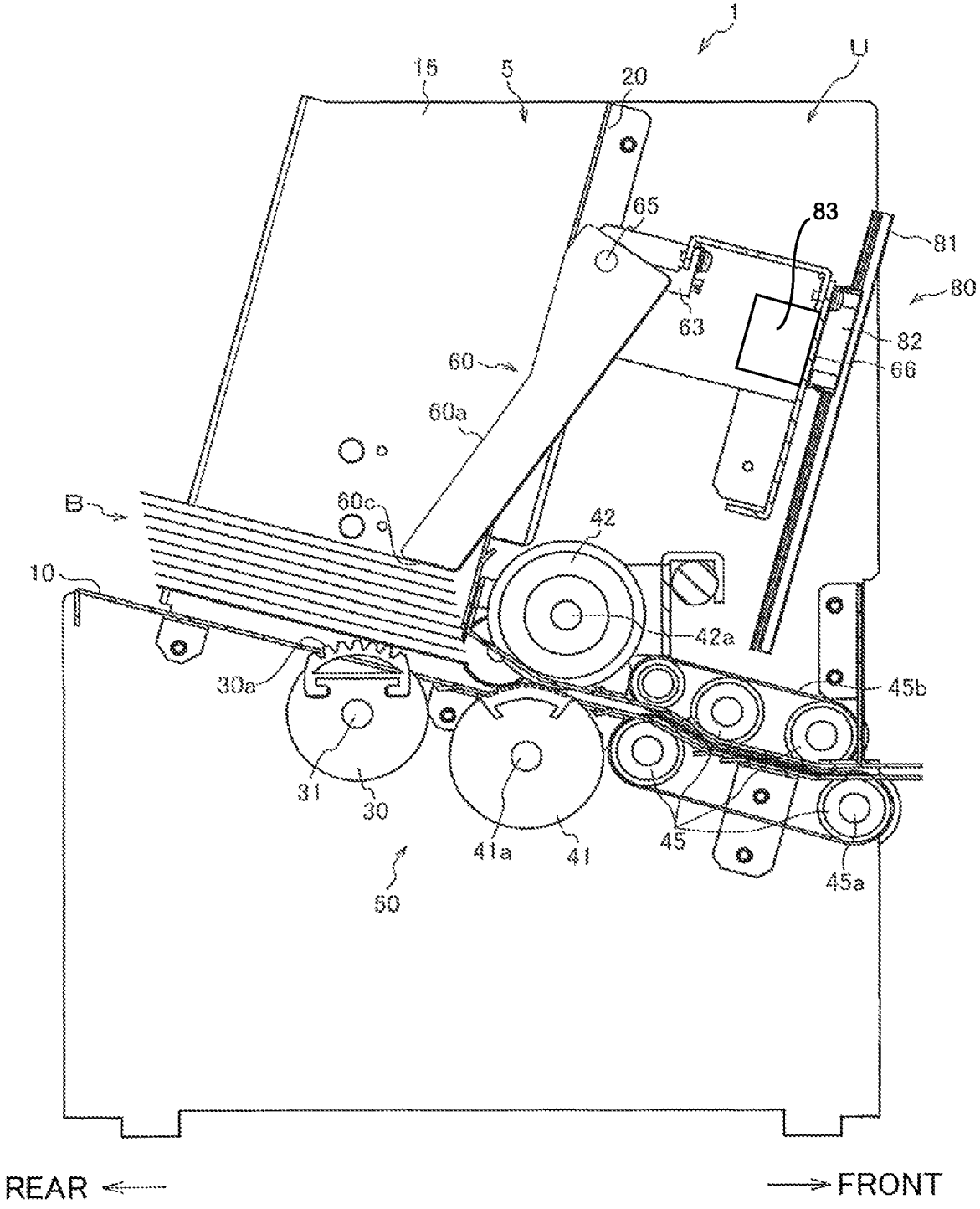
FIG. 10 is a side longitudinal sectional view illustrating a state in which the load adjusting member of the paper sheet loading device is pressing an upper surface of a batch of paper sheets.
Figure 11:
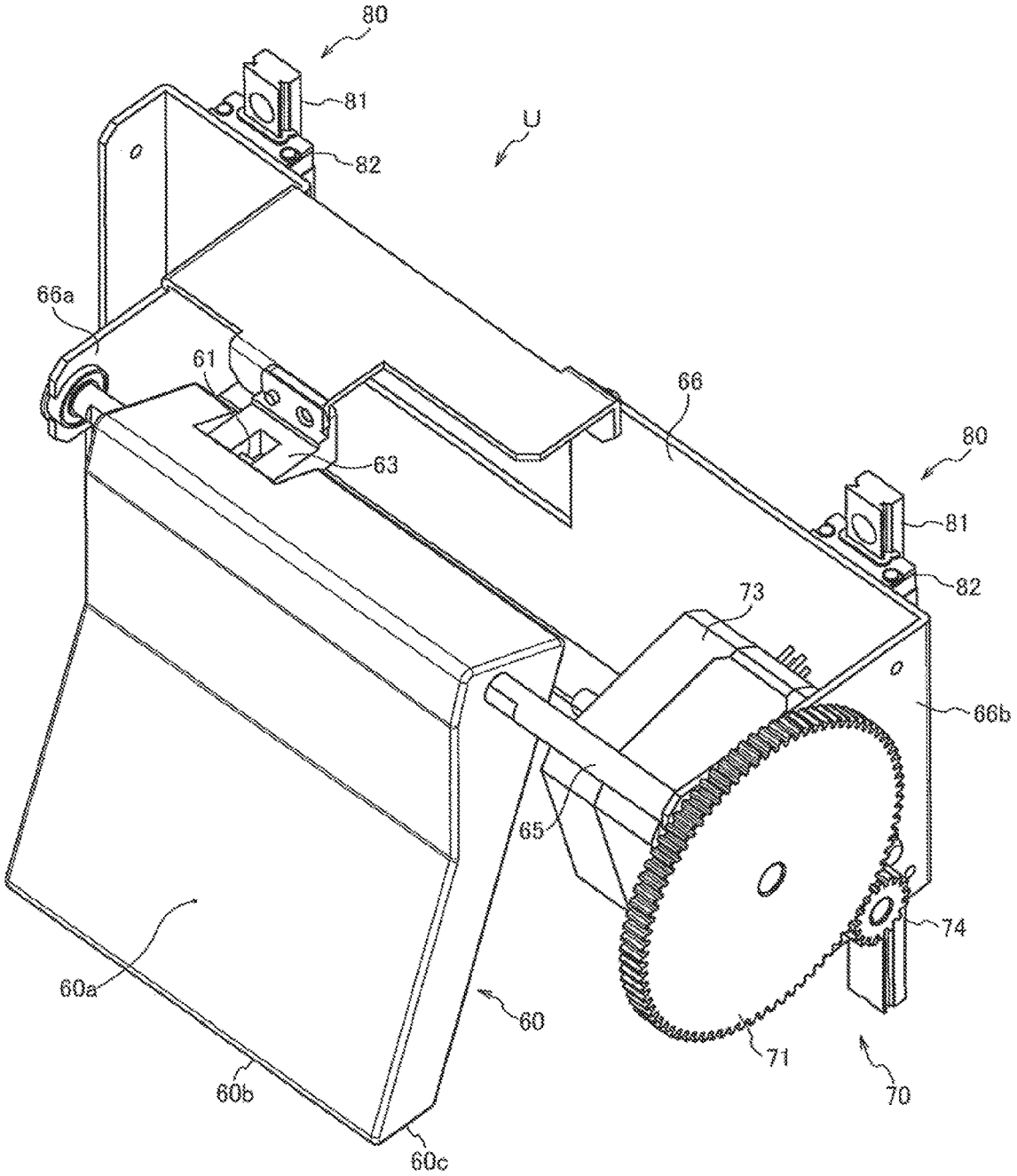
FIG. 11 is a rear side perspective view of an elevating mechanism that activates the load adjusting member.
Figure 12:
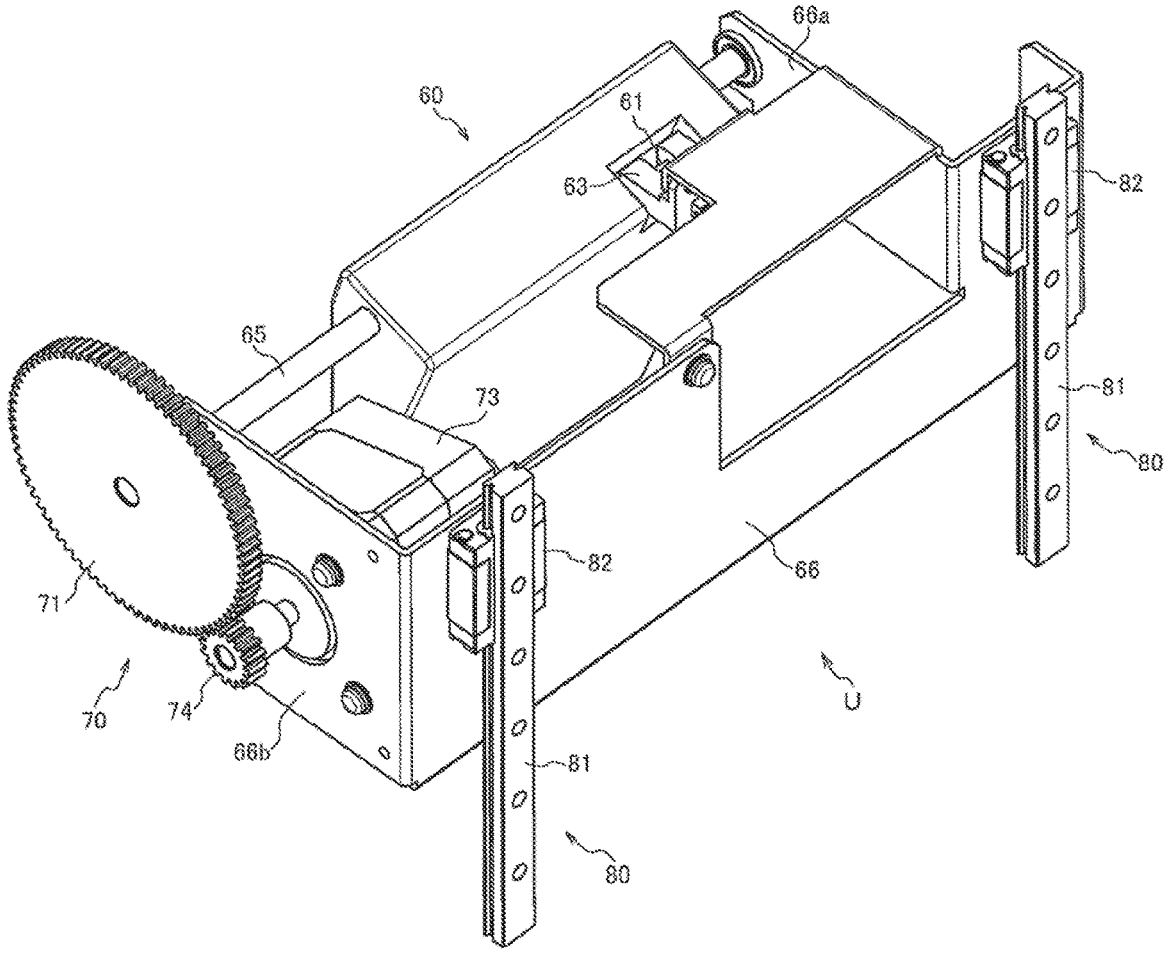
FIG. 12 is a front side perspective view of the elevating mechanism that activates the load adjusting member.

FIGS. 9(*a*) and (*b*) are respectively an elevational view at the time of activation of a load adjusting member of a paper sheet loading device according to a third embodiment of the present invention, and a sectional view taken along Z-Z. FIG. 10 is a side longitudinal sectional view illustrating a state in which the load adjusting member of the paper sheet loading device is pressing an upper surface of a batch of paper sheets. FIG. 11 and FIG. 12 are respectively a rear side perspective view and a front side perspective view of a drive mechanism (elevating mechanism) that activates the load adjusting member.

Parts identical to those of the second embodiment are denoted by like reference signs, and differences from the second embodiment are mainly explained.

The banknote loading device according to the present embodiment is different from that of the second embodiment such that the load adjusting member (the load adjusting unit U) is configured to be able to advance and retreat freely in a vertical direction.

The load adjusting unit U is configured by the load adjusting member 60 as a load adding member, the rotation shaft 65, the support member 66, the drive mechanism 70, and the like. The load adjusting unit U is configured to move up and down by an elevating mechanism (drive mechanism) 80 arranged on the body side of the banknote loading device. The elevating mechanism 80 includes two elevating guide rails 81 arranged parallel to the front wall 20, a slider 82 engaging with the respective elevating guide rails 81 so as to be able to freely move up and down, and a drive source 83 such as a motor or a solenoid. The slider 82 is fixed to a front part of the support member 66, and the load adjusting unit U vertically moves with ascent and descent of the slider 82, and can stop at an arbitrary height position.

Even if a large number of banknotes of more than 1000 sheets are loaded on the bottom plate at the initial stage of counting, as the feed of banknotes proceeds, the remaining number of banknotes decreases. While a large load is applied to the feed roller 30 from the batch of banknotes, the load adjusting member 60 is projected into the banknote loading unit 5 to receive a part of the load from the batch of banknotes, thereby enabling to adjust the load applied to the feed roller to a proper value. However, as illustrated in FIGS. 9A and 9B, if the amount of banknote batch B becomes too small, the load applied from the batch of banknotes to the feed roller becomes too small to cause an erroneous feed. Specifically, if the number of loaded banknotes becomes too small, the batch of banknotes is pushed up by the rotation of the feed roller to cause bound. If the peripheral surface of the feed roller is separated away from the lowermost banknote surface due to the bound, non-contact turning occurs to make the feed timing unstable.

FIG. 9 illustrate a state in which as a result of continuous feeding with a side face of the batch of banknotes being pressed by activating the load adjusting member 60 when the number of loaded banknotes is excessive, the number of loaded banknotes decreases and the position of an upper surface of the batch of banknotes is displaced lower than the bottom surface 60*c* of the load adjusting member.

In order to handle such a problem, according to the present embodiment, the elevating mechanism 80 is activated as illustrated in FIG. 10 to lower the load adjusting unit U as a whole, thereby pressing downward an appropriate place on the upper surface of the banknote batch B (immediately above the feed roller 30) by the bottom surface 60*c* of the load adjusting member 60 in the protruded state. That is, according to the present embodiment, the load adjusting member 60 does not function as a load reducing member, but as a load adding member.

By pressurizing downward a portion of the upper surface of the batch of banknotes corresponding to the position above the feed roller by the bottom surface 60*c* of the load adjusting member, bound can be prevented.

A contact portion between the bottom surface 60*c* of the load adjusting member and the upper surface of the batch of banknotes is above a contact portion between the feed roller and the banknote, and in a range in which the pressurizing force can be transmitted to the contact portion between the feed roller and the banknote.

When the loaded amount of the batch of banknotes on the bottom plate further decreases from the state in FIG. 10, for example, after a decreased state of banknotes is properly detected by the sensor 35, control is executed so that the elevating mechanism 80 is activated to lower the load adjusting unit U sequentially. Alternately, such a configuration is permissible that the load adjusting unit U is energized in a downward direction with a constant force at all times by a drive source constituting the elevating mechanism 80, and the load adjusting member moves down with a decrease in the loaded amount of the batch of banknotes.

The inclination angle when the bottom surface 60*c* of the load adjusting member comes in contact with the upper surface of the batch of banknotes can be set to a proper value (so as to come into surface contact therewith) by adjusting the rotation angle of the rotation shaft 65.

According to the present embodiment, the elevating direction of the load adjusting unit U is parallel to the front wall 20. However, this is only an example, and the load adjusting unit U can move up and down in a direction not parallel to the front wall.

Since the height position of the load adjusting unit U can be arbitrarily adjusted by the elevating mechanism 80, the height position of the load adjusting member at the time of pressing the front side face of the batch of banknotes can be finely adjusted according to the difference in conditions, such as the volume of the loaded amount of the batch of banknotes.

<Load Adjusting Method of Paper Sheet Loading Device>

A load adjusting method (load reducing method) using the paper sheet loading device according to the respective embodiments described above is as described below.

The paper sheet loading device according to the present invention can be ascertained also as the load adjusting method.

That is, the load adjusting method in the paper sheet loading device according to the present invention is a load adjusting method in the paper sheet loading device that includes the paper sheet loading unit 5 having the bottom plate 10 on which a large number of paper sheets are loaded in a stacked state and the front wall 20 that comes in contact with a front side face of the loaded paper sheet batch B to support the paper sheet batch B, a detection unit 35 that detects a loaded amount of the loaded batch of paper sheets, the feed roller 30 that comes in contact with a bottom surface of the lowermost paper sheet of the loaded batch of banknotes and rotates to feed the lowermost paper sheet to outside of the paper sheet loading unit across the front wall, the load adjusting member 60 arranged so as to be able to freely protrude into the paper sheet loading unit and retreat to outside of the paper sheet loading unit across the front wall, the drive mechanisms 70 and 80 that cause the load adjusting unit to protrude, retreat, or move up and down, and the control unit. At the time of protrusion of the load adjusting member, the load adjusting member presses the front side face of the loaded batch of paper sheets by the pressing surface 60*a* to displace the front side face to an innermost part, and receives a load from the paper sheets by the pressing surface, thereby reducing the load applied to the feed roller from the loaded batch of paper sheets. The load adjusting method includes a step at which the detection unit detects a loaded amount of paper sheets on the bottom plate, and a step at which, when the detection unit detects that the loaded amount has exceeded one reference value (a reference value 1), the control unit drives the drive mechanism to project the load adjusting member and then starts driving of the feed roller.

Further, the load adjusting method also includes a step at which, when the detection unit detects that the loaded amount has fallen below another reference value (a reference value 2), the control unit drives the drive mechanism to lower the load adjusting member to the loaded batch of paper sheets to perform pressurization.

Figure 13:
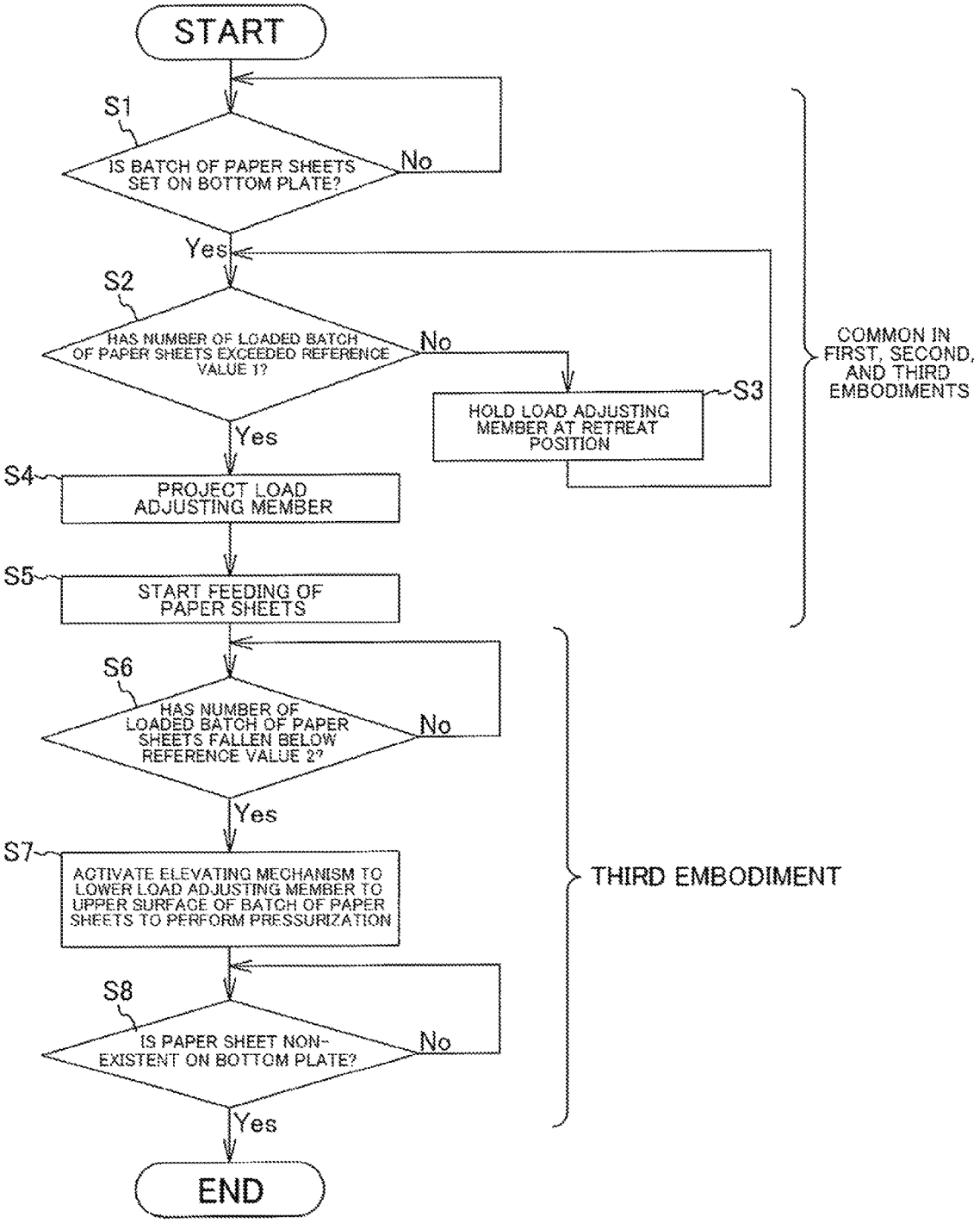
FIG. 13 is a flowchart illustrating a control procedure of a load adjusting method according to the present invention.

FIG. 13 is a flowchart illustrating a control procedure of the load adjusting method.

At step S1, when the sensor 35 detects that a batch of paper sheets is set on the bottom plate 10, at step S3, it is judged whether the number of loaded paper sheets has exceeded the reference value 1 based on an output from the sensor 35. The reference value 1 is a reference to judge whether the load applied to the feed roller becomes excessive to a degree that disables a normal feeding operation by the feed roller 30 in the device. If NO at step S2, control proceeds to step S3, where the load adjusting member is held at a retreat position illustrated in FIG. 1 and FIGS. 2A and 2B. On the other hand, if YES at step S3, control proceeds to step S4, where the control unit activates the drive mechanism 70 to cause the load adjusting member 60 located at the retreat position to be displaced to a protruding position illustrated in FIG. 3 and FIGS. 4A and 4B. At step S5, the control unit activates the drive mechanism 50 to start driving of the feed roller 30, the separation roller pair 40, and the transport roller group 45.

Step S6 and thereafter correspond to those of the third embodiment.

That is, at step S6, it is judged whether the number of loaded paper sheets has fallen below the reference value 2 based on an output from the sensor 35. The reference value 2 is a reference to judge whether the load applied to the feed roller becomes too small to a degree that disables a normal feeding operation by the feed roller 30 in the device.

If the number has fallen below the reference value 2, control proceeds to step S7 to activate the elevating mechanism 80 to lower the load adjusting member 60 so as to come in contact with the upper surface of the loaded batch of paper sheets, and perform pressurization.

Further, at step S8, the control unit judges whether there is a remaining loaded paper sheet based on a detection signal from the sensor 35, and if there is no remaining loaded paper sheet, the control unit ends the process.

<Application Example of Paper Sheet Loading Device>

Figure 14:
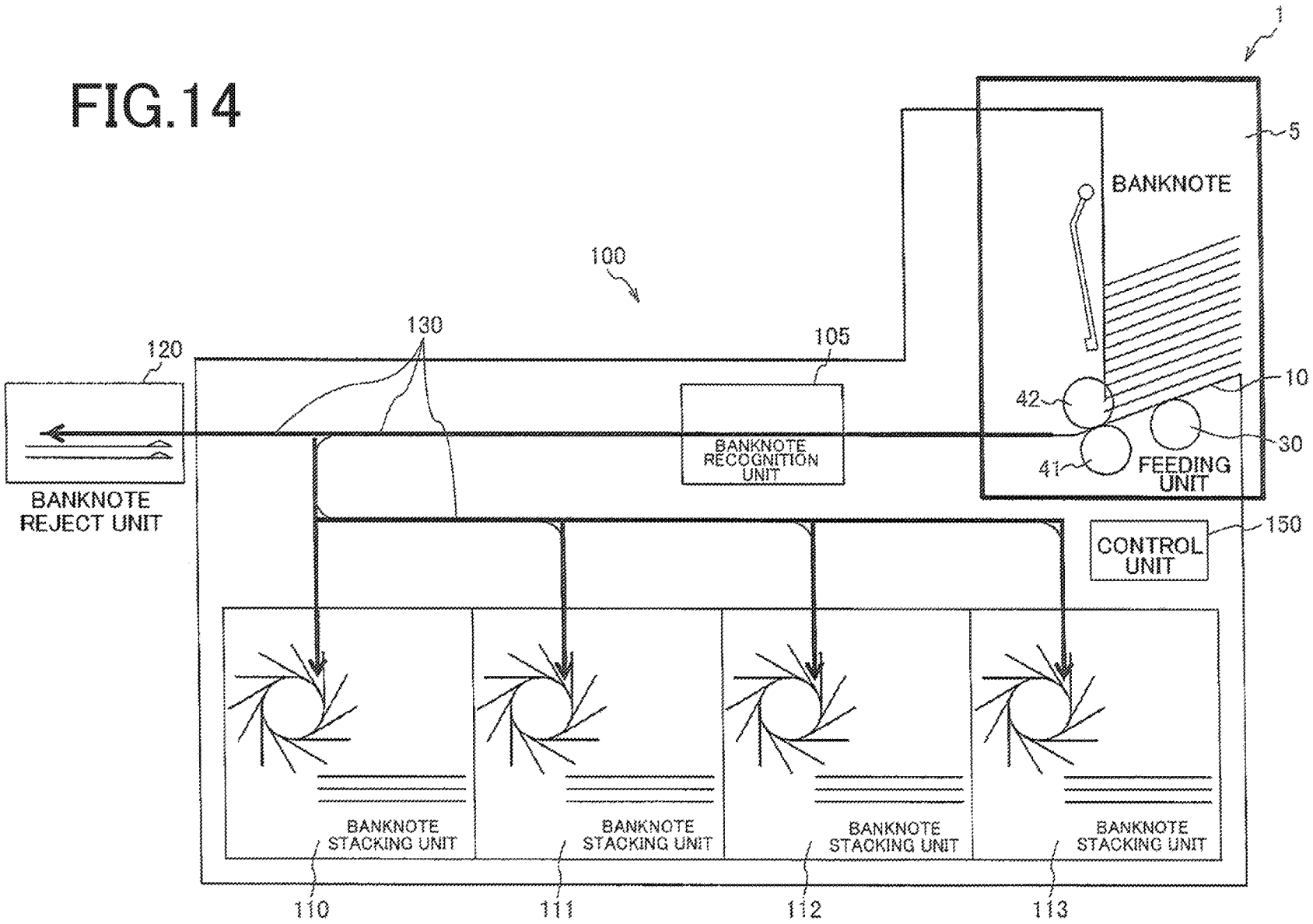
FIG. 14 is an explanatory diagram of a schematic configuration of a banknote processing machine as an example of a paper sheet handling device to which the paper sheet loading device according to the present invention is applied.

FIG. 14 is an explanatory diagram of a schematic configuration of a banknote processing machine as an example of the paper sheet handling device to which the paper sheet loading device according to the present invention is applied.

A banknote processing machine 100 generally includes a banknote loading device 1, a banknote recognition unit 105 that judges the denomination, the authenticity, and the like of a banknote fed from the banknote loading device 1, banknote stacking units 110 to 113 that store by denomination banknotes having subjected to judgment of denomination by the banknote recognition unit 105, a banknote reject unit 120 that stores rejected banknotes, a transport mechanism 130, and a control unit 150.

If the banknote recognition unit 105 judges that a banknote fed from the banknote loading device 1 is a banknote that cannot be accepted, the control unit 150 transports the banknote to the banknote reject unit 120 by driving the transport mechanism 130. If the banknote is an authentic banknote that can be accepted, the control unit 150 sorts the banknote by denomination to any of the banknote stacking units 110 to 113.

The banknote loading device 1 can maintain the load to the feed roller 30 at a proper value at all times by using the load adjusting member 60. Therefore, erroneous feed such as double feeding, skew, or non-contact turning of the feed roller can be prevented, thereby enabling to prevent a decrease of operating rates of the banknote processing machine 100.

The banknote loading device can be applied not only to a counting device but also to banknote handling devices such as various vending machines, deposit and dispense devices, and money change machines.

<Summary of Configurations, Operations, and Effects of Present Invention>

The paper sheet loading device according to the first invention includes the paper sheet loading unit 5 having the bottom plate 10 on which a large number of paper sheets (batch of paper sheets) are loaded in a stacked state, and the front wall 20 that comes in contact with a front side face of the loaded paper sheet batch B to support the batch of paper sheets. The paper sheet loading device also includes the feed roller 30 that comes in contact with the bottom surface of the lowermost paper sheet of the loaded batch of paper sheets and rotates to feed the lowermost paper sheet to outside of the paper sheet loading unit across the front wall 20, and the load adjusting member 60 arranged so as to be able to freely protrude into the paper sheet loading unit 5 and retreat to outside of the paper sheet loading unit across the front wall. At the time of protrusion of the load adjusting member, the load adjusting member presses the front side face of the loaded batch of paper sheets by the pressing surface 60*a* to displace the front side face to the innermost part, and receives the load from the batch of paper sheets by the pressing surface, thereby reducing the load applied to the feed roller from the loaded batch of paper sheets.

Since the pressing surface 60*a* squeezes in an appropriate place of the front side face of the loaded batch of paper sheets when the load adjusting member is at the protruding position, a part of the load of the paper sheet group with the front edge coming in contact with the pressing surface 60*a*, and the paper sheet group on top thereof is received by the pressing surface. Therefore, a load corresponding to the received load is reduced from the load applied to the feed roller. The paper sheets pressed by the pressing surface 60*a* are in a state with the front edge coming contact with the pressing surface, regardless of the size of the paper sheets. Accordingly, the pressing surface exerts a function of dispersing the load from the paper sheets. As feeding of the paper sheets by the feed roller proceeds and the paper sheets being in contact with the pressing surface are lowered and separated sequentially from the pressing surface, the upper banknotes that have not been in contact with the pressing surface sequentially come down to transit to a state with the front edge coming in contact with the pressing surface. Accordingly, the function of dispersing the load by the pressing surface is still exerted continuously.

Further, the paper sheet group Bd located below the paper sheet group Bm with the front edge being in contact with the pressing surface is deformed rearward (in a direction opposite to the paper sheet feeding direction) to become the shape of parallelogram. Therefore, a part of the load of the paper sheet group at the rear side is dispersed on the bottom plate, and a load corresponding to the dispersed load is reduced from the load applied to the feed roller.

The shape, the structure, and the material of the load adjusting member 60 are selected so as to be able to exert the load reducing function and the load adding function.

Protruding/retracting and advancing/retreating routes of the load adjusting member 60 can be curved or linear.

The paper sheet is not limited to a banknote, and includes various paper sheets such as tickets, marketable securities, and voting slips.

The batch of paper sheets means a plurality of paper sheets overlapped and bundled together. It also includes a case where individual paper sheets of different sizes, shapes, thicknesses, and materials constituting the batch are stacked and bundled together.

The loaded batch of paper sheets means a batch of paper sheets in which a plurality of paper sheets are vertically stacked in an overlapped state. It also includes not only a case as in the example of the embodiments in which individual paper sheets are slightly displaced in the surface direction and as a result, the entire front side face BF is inclined and stacked, but also a case where the entire front side face BF is vertically stacked without displacement of the individual paper sheets in the surface direction.

The paper sheet loading device can be applied not only to a counting device but also to banknote handling devices such as various vending machines, deposit and dispense devices, and money change machines. That is, these banknote handing devices have a function of storing banknotes loaded by a user or banknotes prepared beforehand in a banknote storing unit such as a safe in a stacked state and feeding one by one as change or dispensed money upon reception of a feeding request. When banknotes exceeding an appropriate load of the feed roller are loaded in the banknote storing unit, erroneous feed can be solved by exerting the load reducing function according to the present invention. When there is a possibility of occurrence of erroneous feed because the number of loaded banknotes is too small, the load adding function can be exerted by applying the present invention.

The paper sheet loading device according to the second invention is characterized such that the load adjusting member 60 advances and retreats with respect to the paper sheet loading unit along an arc-like trajectory around the rotation shaft 65.

For example, by turning the load adjusting member in the front and back direction by supporting an upper part of the load adjusting member by the rotation shaft, the front side face of the loaded batch of paper sheets is squeezed in and deformed by the pressing surface of the load adjusting member located below the rotation shaft. Since the pressing surface squeezes in the paper sheet group being in contact therewith by scooping up the paper sheet group in the arc-like trajectory, a part of the load of the paper sheet group with the front edge being in contact with the pressing surface and the paper sheet group located on top thereof can be received by the pressing surface.

Further, by supporting a lower part of the load adjusting member by the rotation shaft, the front side face of the loaded batch of paper sheets can be squeezed in and deformed by the pressing surface located above the rotation shaft.

The paper sheet loading device according to the third invention is characterized such that the load adjusting member 60 advances and retreats with respect to the paper sheet loading unit along a linear trajectory.

The linear trajectory includes a linear trajectory from an obliquely upward direction to an obliquely downward direction, and a linear trajectory from an obliquely downward direction to an obliquely upward direction, in addition to a horizontal trajectory.

By configuring such that the pressing surface is obliquely upward when pressing the front side face of the loaded batch of paper sheets by the pressing surface, even if the load adjusting member is moved linearly to the protruding position, the pressing surface can receive the load from the banknotes.

The paper sheet loading device according to the fourth invention is characterized such that the load adjusting member 60 comes in contact with an upper surface of the batch of paper sheets on the bottom plate 10 to pressurize the upper surface, thereby adjoining (adding, assisting) the load to the feed roller.

When the feeding operation proceeds and the amount of loaded batch of paper sheets decreases, the feeding load to the feed roller may become insufficient to cause an erroneous feed. In this case, it is effective to bring the load adjusting member into contact with the upper surface of the batch of paper sheets to pressurize the batch of paper sheets downward.

The paper sheet loading device according to the fifth invention is characterized such that the load adjusting member 60 is configured so as to be able to advance and retreat along a loading direction of the loaded batch of paper sheets.

When the number of loaded batch of paper sheets decreases, it is necessary to bring the load adjusting member into contact with the upper surface of the loaded batch of paper sheets to pressurize the batch of paper sheets downward. By configuring the load adjusting member so as to be able to advance and retreat vertically, the load adjusting member can be lowered to the upper surface of the loaded batch of paper sheets to start pressurization at an arbitrary timing. When pressurization becomes not necessary, the load adjusting member can be retreated upward.

Further, the height position when the load adjusting member presses the batch of paper sheets can be finely adjusted.

The load adjusting method according to the sixth invention is characterized by including a step at which the detection unit according to the first to fifth invention detects a loaded amount (a stacked amount, an accumulated amount) of paper sheets on the bottom plate, and a step at which, when the detection unit detects that the loaded amount has exceeded one reference value, the control unit drives the drive mechanism to project the load adjusting member and then starts driving of the feed roller.

According to the load adjusting method including the above steps, an optimum feeding load can be applied to the feed roller by adjusting the load applied to the feed roller from the loaded batch of paper sheets and load balance by a simple operation of only projecting the load adjusting member.

The load adjusting method according to the seventh invention is characterized such that an elevating mechanism for moving the load adjusting member up and down is provided, and is characterized by including a step at which, when the detection unit detects that the loaded amount has fallen below another reference value, the control unit drives the elevating mechanism to lower the load adjusting member onto the loaded batch of paper sheets and perform pressurization.

With this method, an optimum feeding load can be applied to the feed roller by adjusting the load applied to the feed roller from the loaded batch of paper sheets and load balance by a simple operation of only elevating the load adjusting member.

REFERENCE SIGNS LIST

1 . . . banknote counting device (paper sheet counting device), 5 . . . banknote loading unit (paper sheet loading unit), 10 . . . bottom plate, 15, 16 . . . side plate, 20 . . . front wall, 21 . . . opening portion, 30 . . . feed roller, 30*a* . . . high frictional portion, 31 . . . rotation shaft, 32 . . . pulley, 35 . . . detection unit (sensor), 40 . . . separation roller pair, 41 . . . friction roller, 41*a* . . . rotation shaft, 41*b* . . . pulley, 42 . . . reverse roller, 45 . . . transport roller, 45*a* . . . rotation shaft, 45*b* . . . belt, 46 . . . pulley, 50 . . . drive mechanism, 51 . . . motor, 51*a* . . . output pulley, 53 . . . timing belt, 60 . . . load adjusting member, 60*a* . . . pressing surface, 60*b* . . . tip edge (lower tip edge), 60*c* . . . bottom surface, 61 . . . detection piece, 63 . . . sensor, 65 . . . rotation shaft, 66 . . . support member, 66*a* . . . side plate, 70 . . . drive mechanism, 71 . . . driven gear, 73 . . . motor, 74 . . . output gear, 80 . . . elevating mechanism, 81 . . . elevating guide rail, 82 . . . slider, 100 . . . banknote processing machine (paper sheet processing machine), 105 . . . banknote recognition unit (paper sheet recognition unit), 110 . . . banknote stacking unit (paper sheet stacking unit), 120 . . . banknote reject unit (paper sheet reject unit), 130 . . . transport mechanism, 150 . . . control unit

The invention claimed is:

1. A paper sheet loading device comprising:

a paper sheet loading unit having a bottom plate on which a batch of paper sheets is loaded, and a front wall that comes in contact with a front side face of the batch of paper sheets to support the batch of paper sheets;

a feed roller that comes in contact with a bottom surface of a lowermost paper sheet of the batch of paper sheets and rotates to feed the lowermost paper sheet to outside of the paper sheet loading unit across the front wall; and a load adjusting member arranged so as to be able to freely protrude into the paper sheet loading unit and retreat to outside of the paper sheet loading unit across the front wall, wherein at a time of protrusion of the load adjusting member, the load adjusting member presses a front side face of the batch of paper sheets by a pressing surface to displace the front side face in a direction away from the front wall, and receives a load from the batch of paper sheets by the pressing surface, thereby reducing a load applied to the feed roller from the batch of paper sheets, and the load adjusting member comes in contact with an upper surface of a loaded batch of paper sheets on the bottom plate to pressurize the upper surface, thereby adding a load to the feed roller.

2. The paper sheet loading device according to claim 1, wherein the load adjusting member advances and retreats with respect to the paper sheet loading unit along an arc shaped trajectory around a rotation shaft.

3. The paper sheet loading device according to claim 1, wherein the load adjusting member advances and retreats with respect to the paper sheet loading unit along a linear trajectory.

4. The paper sheet loading device according to claim 1, wherein the load adjusting member is configured so as to be able to advance and retreat along a loading direction of the loaded batch of paper sheets.

5. A load adjusting method in a paper sheet loading device that includes a paper sheet loading unit having a bottom plate on which paper sheets are loaded and a front wall that comes in contact with a front side face of a batch of paper sheets to support the batch of paper sheets, a detection unit that detects a loaded amount of the batch of paper sheets, a feed roller that comes in contact with a bottom surface of a lowermost paper sheet of the batch of paper sheets and rotates to feed the lowermost paper sheet to outside of the paper sheet loading unit across the front wall, a load adjusting member arranged so as to be able to freely protrude into the paper sheet loading unit and retreat to outside of the paper sheet loading unit across the front wall, a drive mechanism that causes a load adjusting unit to protrude, retreat, or move up and down, and a control unit, wherein the drive mechanism includes a retractable drive mechanism and an elevating mechanism, the retractable drive mechanism including a motor, an output gear and a driven gear, and the elevating mechanism including an elevating guide rail, a slider and a drive source, and wherein at a time of protrusion of the load adjusting member, the load adjusting member presses a front side face of the batch of paper sheets by a pressing surface to displace the front side face to in a direction away from the front wall, and receives a load from the paper sheets by the pressing surface, thereby reducing a load applied to the feed roller from the batch of paper sheets, the load adjusting method comprising:

a step at which the detection unit detects a loaded amount of paper sheets on the bottom plate;

a step at which, when the detection unit detects that the loaded amount has exceeded one reference value, the control unit drives the drive mechanism to project the load adjusting member and then starts driving of the feed roller; and a step at which, when the detection unit detects that the loaded amount has fallen below another reference value, the control unit drives the drive mechanism to lower the load adjusting member onto the loaded batch of paper sheets and perform pressurization.

* * * * *